United States Patent [19]

Daikoku et al.

[11] 4,363,013

[45] Dec. 7, 1982

[54] WINDING STRUCTURE FOR STATIC ELECTRICAL INDUCTION APPARATUS

[75] Inventors: Takahiro Daikoku, Ushikumachi; Masahiro Ikegawa, Shimoinayoshi; Wataru Nakayama, Kashiwa; Taisei Uede, Hitachi, all of Japan

[73] Assignee: Hitachi, Ltd., Tokyo, Japan

[21] Appl. No.: 192,329

[22] Filed: Sep. 29, 1980

Related U.S. Application Data

[62] Division of Ser. No. 888,996, Mar. 22, 1978, Pat. No. 4,245,206.

[30] Foreign Application Priority Data

| | | | |
|---|---|---|---|
| Mar. 26, 1977 | [JP] | Japan | 53/33454 |
| Mar. 26, 1977 | [JP] | Japan | 53/33455 |
| Feb. 6, 1978 | [JP] | Japan | 54/11455 |
| Feb. 6, 1978 | [JP] | Japan | 54/11457 |
| Feb. 6, 1978 | [JP] | Japan | 54/11458 |

[51] Int. Cl.[3] ..... H01F 27/08

[52] U.S. Cl. ..... 336/60

[58] Field of Search ..... 336/55, 57, 58, 60, 336/185, 207; 310/65

[56] References Cited

U.S. PATENT DOCUMENTS

| | | | |
|---|---|---|---|
| 2,339,625 | 1/1944 | De Blieux | 336/60 |
| 3,902,146 | 8/1976 | Muralidharan | 336/57 |
| 4,000,482 | 12/1976 | Staub et al. | 336/60 |
| 4,028,653 | 6/1977 | Carlsson | 336/60 |

FOREIGN PATENT DOCUMENTS

| | | | |
|---|---|---|---|
| 46-15364 | 5/1971 | Japan | 336/60 |
| 49-18656 | 5/1974 | Japan | 336/60 |
| 51-27416 | of 1976 | Japan | 336/60 |
| 51-61221 | of 1976 | Japan | 336/60 |
| 52-28618 | of 1977 | Japan | 336/60 |

*Primary Examiner*—Thomas J. Kozma

*Attorney, Agent, or Firm*—Antonelli, Terry & Wands

[57] ABSTRACT

Winding structure for static electrical induction apparatus such as transformers, reactors, or the like. A winding assembly is disposed in a space formed between a pair of inner and outer insulation continuous walls which are disposed in a container so as to commonly include the vertical axis of the container thereby defining the space therebetween. An inner vertical coolant passage is formed between the winding assembly and the inner insulation wall and an outer vertical coolant passage is also formed between the winding assembly and the inner insulation wall. The winding assembly is composed of a plurality of coil units stacked on one another in the vertical direction with separation at predetermined intervals so as to form horizontal coolant passages between vertically adjacent ones of the coil units, the inner and outer vertical coolant passages communicating with each other through the horizontal coolant passages.

A plurality of coolant flow control members are disposed in discrete relation from one another in at least selected one of the inner and outer vertical coolant passages in a manner so that a horizontal sectional area of the selected vertical coolant passage is decreased periodically at a pitch of nP along the vertical direction where n represents an integer which is not smaller than two (2) and P represents a pitch of the coil units along the vertical direction.

Further, each of the coil units may be divided into at least two, inner and outer, coil sub-units disposed concentrically with each other in a common horizontal plane to thereby additionally form an intermediate vertical coolant passage between the vertically stacked inner coil sub-units and the vertically stacked outer coil sub-units. The coolant flow control members are disposed only in this intermediate vertical coolant passage to decrease periodically the horizontal sectional area thereof at the pitch of nP in the same manner as mentioned above.

3 Claims, 52 Drawing Figures

WINDING STRUCTURE FOR STATIC ELECTRICAL INDUCTION APPARATUS

This is a division of application Ser. No. 888,996, now U.S. Pat. No. 4,245,206, filed Mar. 22, 1978.

BACKGROUND OF THE INVENTION

The present invention relates to a static electrical induction apparatus such as transformers, reactors or the like and in particular to a winding structure for such induction apparatus which is provided with a cooling arrangement.

There is hitherto known such a winding structure for the static electrical induction apparatus in which an annular winding assembly constituted by a plurality of vertically stacked coil units is disposed in an annular space defined between an inner insulation cylinder and an outer insulation cylinder so as to define an inner and an outer paths to allow coolant in aqueous or liquid phase to flow in the vertical direction by natural circulation. Such paths are referred to hereinafter as vertical cooling or coolant passages. Further, the coil units are spaced from one another to define between the adjacent ones of the horizontal cooling passages which are communicated with the inner and the outer vertical cooling passages. With such arrangement of the cooling passages only, the flow of the coolant in the cooling passages is too gentle to attain a desired cooling effect for the winding assembly. This is particularly true for the case where the coolant is to flow under natural circulation. With attempt to delete this disadvantage in the apparatus of the natural circulation type, there has been proposed to divide each of the coil units constituting the winding assembly into two conventional sub-units thereby to define an intermediate vertical passage extending vertically in the axial direction of the winding assembly between the inner and the outer coil sub-units. Such intermediate vertical cooling passage is certainly effective for lowering the temperature at the mid portion of the coil units. However, the coolant flow in the horizontal passages remains still at a low level so that the temperature at middle portions of the divided coil sub-units will be locally increased. Of course, the number of the intermediate vertical passages may be increased through corresponding divisions of the disk-like coil units. However, this involves correspondingly enlarged width of the coil-units and hence of the winding assembly, which means anything but an increased dimension or bulkiness of the static electrical induction apparatus for a given capacity.

In the apparatus of the forced cooling type, on the contrary, there has been proposed to divide the whole cooling region into several sections in each of which a flow deflector or baffle plate is provided thereby to cause coolant flow in a zig-zag flow pattern for every cooling region. However, such attempts have not led to satisfactory results. The coil units constituting the winding assembly can not be cooled uniformly and there arises a danger of local abnormal temperature rise occurring in the respective cooling regions which may eventually degrade the used insulation material of the winding assembly and thus reduce the use life of the induction apparatus.

In an effort to evade the difficulties in the cooling of the winding assembly, the induction apparatus is used at a low current density in the individual conductors constituting the winding, or the winding assembly is designed and manufactured so as to prevent the unwanted local temperature rise from occurring even at the regions where the most slow flow of the coolant is likely to take place. Such measures will apparently involve a remarkably increased dimension or bulkiness of the winding assembly and the induction apparatus for a given capacity.

It is also known to increase the number of the deflector plate for causing the coolant flow in the zig-zag pattern or provide additionally flow adjusting members having a similar function as the deflector plate in an effort to attain a coolant flow as uniformly as possible. Such arrangements however suffer from drawbacks that the fluid pressure loss of the current is considerably increased and, additionally, the arrangement of the coolant passages becomes very complicated thereby making it difficult to obtain a compatibility of the winding assembly with the adjacent other winding such as cylindrical winding in respect of the distribution of the coolant flows.

SUMMARY OF THE INVENTION

An object of the invention is therefore to provide an improved winding structure for static electrical induction apparatus which avoids the disadvantages of hitherto known winding structures as described above and permits a uniform and effective cooling of the winding structure by enhancing the coolant flow in the horizontal cooling passages to thereby suppress the local temperature rise.

In view of the above and other objects which will become more apparent as description proceeds, there is proposed according to a feature of the invention a winding structure for static electrical induction apparatus. A winding assembly is disposed in a space formed between a pair of inner and outer insulation continuous walls which are disposed in a container so as to commonly include the vertical axis of the container thereby defining the space therebetween. An inner vertical coolant passage is formed between the winding assembly and the inner insulation wall and an outer vertical coolant passage is also formed between the winding assembly and the inner insulation wall. The winding assembly is composed of a plurality of coil units stacked on one another in the vertical direction with separation at predetermined intervals so as to form horizontal coolant passages between vertically adjacent ones of the coil units, the inner and outer vertical coolant passages communicating with each other through the horizontal coolant passages.

A plurality of coolant flow control members are disposed in discrete relation from one another in at least selected one of the inner and outer vertical coolant passages in a manner so that a horizontal section area of the selected vertical coolant passage is decreased periodically at a pitch of nP along the vertical direction where n represents an integer which is not smaller than two (2) and P represents a pitch of the coil units along the vertical direction.

Further, each of the coil units may be divided into at least two, inner and outer, coil sub-units disposed concentrically with each other in a common horizontal plane to thereby additionally form an intermediate vertical coolant passage between the vertically stacked inner coil sub-units and the vertically stacked outer coil sub-units. The coolant flow control members are disposed only in the intermediate vertical cooling passage so as to decrease periodically the flow cross-sectional area thereof at the pitch nP in the manner described above.

DETAILED DESCRIPTION OF THE PREFERRED EMBODIMENTS

In order to have a better understanding of the invention, description will be made first on the state of the prior art by referring to FIGS. 1 to 6 of the accompanying drawings before entering into detailed description of exemplary embodiments of the invention.

Figure 1:
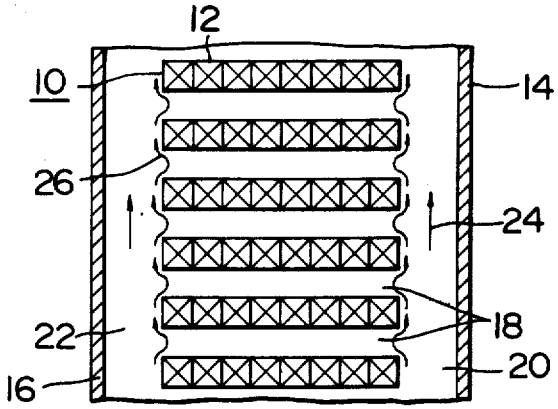
FIG. 1 PRIOR ART
FIGS. 1 to 6 show typical examples of hitherto known winding structures for static electrical induction apparatus in fragmental sectional elevations.

FIG. 1 shows a hitherto known primitive structure of a winding assembly for a static induction apparatus such as transformer, reactor or the like in a fragmental vertical cross-section with other half portion of the winding symmetrical relative to the vertical axis of the winding being emitted from the illustration. The winding structure shown in this figure is adapted to undergo usually a natural cooling. The static induction apparatus comprises outer and inner insulation cylinders 14 and 16 definning therebetween an annular chamber in which the winding assembly or winding structure is accommodated. The winding assembly is composed of a plurality of disk-like annular coil units 10 disposed in a vertical alignment with one another around the axis of the winding assembly. Each of the coil units is formed by winding conductor wires 12. The coil units 10 are vertically spaced from one another by means of horizontally disposed spacer members (not shown), whereby a plurality of horizontal cooling passages 18 are defined between the adjacent coil units. On the other hand, the inner sides (i.e. right-hand side as viewed in FIG. 1) of the whole coil units 10 are spaced from the inner wall of the inner insulation cylinder 14 by means of vertically disposed mount and spacer members (not shown) thereby to form an inner vertical cooling passage 24 extending vertically around the axis of the winding assembly. In a similar manner, the outer sides (i.e. the left-hand side as viewed in the figure) of the whole coil units 10 are spaced from the outer insulation cylinder 16 thereby to define another vertical cooling passage or path 22.

With such arrangement of the cooling passages or paths as described above, a cooling fluid which may be in a liquid or gaseous phase in dependence of particular applications of the static induction apparatus may flow in the directions indicated by arrows as the temperature of the individual coil unit 10 rises during the operation of the apparatus. In this connection, it should be noted that the flow rate of the coolant in the horizontal cooling passages 18 is extremely low, since the coolant will be more likely to flow through the vertical passages 22 and 24 under natural circulation. Consequently, temperature of mid portions of the individual coil units 10 wil be locally increased, involving danger of these mid portions being overheated. Such danger may be prevented from occurring by enlarging the cross-section of the horizontal cooling passages 18, which means however that the size or dimension of the winding assembly or structure itself has to be disadvantageously increased.

Figure 2:
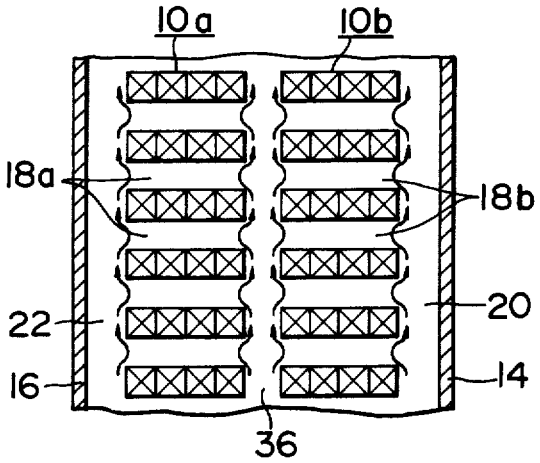
FIG. 2 PRIOR ART

As an attempt to avoid the above disadvantage, there has been heretofore proposed a winding structure as shown in FIG. 2 which is different from the one shown in FIG. 1 in that each of the coil units 10 is divided into a plurality of co-centrical coil sub-units such as the two sub-units 10*a* and 10*b* thereby to form a mid vertical cooling passage 36. The provision of such additional coolant passage 36 is certainly effective to lower the temperature of the mid regions of the individual coil units in which the vertical passage 36 is formed. However, the flow rate of the coolant in the horizontal coolant passages 18*a* and 18*b* will remain extremely low as is in the case of the cooling passage arrangement shown in FIG. 1. Consequently, the temperature at the middle portions of the divided coil sub-units 10*a* and 10*b* will be locally increased. Of course, more effective cooling effect may be obtained by increasing the number of the coil sub-units such as 10*a* and 10*b* and hence the number of the vertical coolant passages. However, the increase in the number of the vertical coolant passages will result in an undesirable corresponding increase in the diameter of the coil unit 10 and hence the size of the whole winding assembly.

Figure 3:
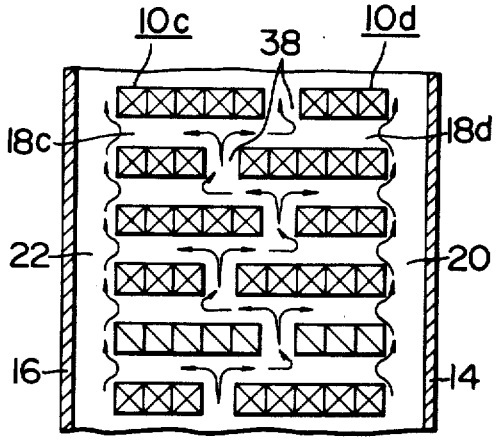
FIG. 3 PRIOR ART

Further, a winding structure such as shown in FIG. 3 has been proposed as an improvement over the structure shown in FIG. 2. In the case of this winding structure, it will be noted that each of the coil units 10 is divided into a preselected number (two in the illustrated structure) of coil sub-units such as 10*c* and 10*d*, whereby additional vertical passages 38 are formed in a zig-zag pattern as viewed in the axial direction. With such arrangement of the coolant passages, the coolant flowing through the zig-zag vertical passage 38 will be obstructed by the wider coil sub-unit 10*c* and diverted to the horizontal passage sections 18*c* and 18*d*. When the rate of coolant flow is low as a whole, as is in the case of a transformer winding of a natural circulation type, the flow rate in the zig-zag vertical passage 38 is as low as the flow rate in the horizontal passages 18, which results in a much reduced flow rate in the horizontal passage section which underlies the coil sub-units 10*d* having a smaller width. Consequently, the coolant flow will become stagnant or flow very slowly in the horizontal passage sections 18*d* underlying the narrow coil unit 10*d*, whereby the temperature at a middle portion of the divided coil sub-unit 10*d* will be locally increased. In order to eliminate such disadvantage, the coolant passages and hence the winding structure itself will have to be of a great size.

Figure 4:
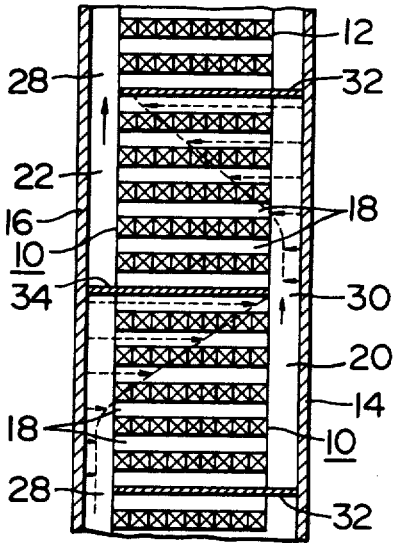
FIG. 4 PRIOR ART

FIG. 4 shows another winding structure of the forced cooling type which has been already proposed and in which the individual coil units 10 are grouped into a plurality of winding sections each including a predetermined number of the coil units 10 and baffle or deflector plates for controlling the flow of coolant are provided for each of the winding sections. The structure shown in FIG. 4 is primarily intended for a static induction apparatus of an enforced cooling type. As can be seen from this figure, the cooling in the winding assembly is effected by deflecting the coolant flow from the inner vertical coolant passage 20 toward the outer vertical coolant passage 22 and thence back to the latter in a zig-zag or meandering pattern. More specifically, a predetermined number (five in the case of the illustrated structure) of the coil units 10 are grouped into one winding section, wherein the baffle or deflector plates 32 and 34 are disposed so as to define inlet and outlet ports 28 and 30 alternately at the inner and outer vertical cooling passages 20 and 22 for each of the winding sections with a view to causing the coolant flow through the horizontal cooling or coolant passages 18 from one of the vertical flow passages 20 and 22 to the other in one winding section and vice-versa in the succeeding section and so forth.

The cooling arrangement of the winding assembly provides certainly an improvement over the arrangement shown in FIG. 1. However, there still remains a problem to be solved that, in each of the winding sections disposed between the baffle or deflector plates 32 and 34, the lower coil units 10 located in the vicinity of the inlet opening of the coolant flow is not adequately cooled as compared with the upper coil unit 10 positioned near to the outlet opening of the coolant flow. More specifically, the flow rates of the coolant in the horizontal coolant passages 18 formed among the coil units 10 disposed between the deflector plates 32 and 34 will differ from one another. Consequently, the coolant flow rate distribution within the single winding section will become non-uniform as represented by broken lines in FIG. 4 with the coolant flow quantity at the upper portion of the winding section being considerably greater than at the lower portion. For these reasons, uniformity in the cooling effect and temperature of the individual coil units 10 of the winding assembly can not be attained even though that the coolant is caused to flow in a zig-zag or meandering pattern due to the provisions of the deflector plates 32 and 34, and there is a danger that an abnormal temperature rise may locally occur in the grouped winding sections so as to result in a deteriorating of the used insulating material thereby eventually shortening the useful life of the winding assembly.

As other attempts to attain a uniform coolant flow throughout the winding assembly, the number of the baffle or deflector plates such as 32 and 34 for producing the zig-zag flow pattern is increased and/or flow control members having similar function as the deflector plates are employed. However, these attempts lead to much complicated arrangements of the cooling passages which give rise to a significant loss in the fluid pressure and additionally encounter with difficulty in determining the relationship between the disk winding assembly and other winding such as a cylindrical winding positioned adjacent thereto.

Figure 5:
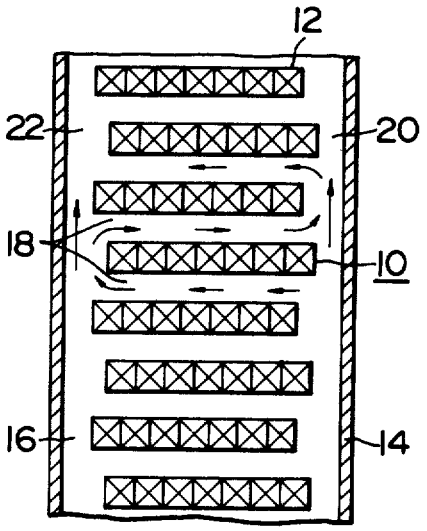
FIG. 5 PRIOR ART

FIG. 5 shows another winding structure as an improvement of the winding assembly shown in FIG. 4. In the case of this winding structure, the flow deflector or baffle plates 32 and 34 in the structure shown in FIG. 4 are omitted and instead thereof the inner and the outer diameters of the individual coil units 10 are alternately increased and decreased, thereby to alternately increase and decrease the cross-sectional areas of the inner and outer vertical coolant passages 20 and 22 in a zig-zag pattern as viewed in the axial direction. In other words, the inner ends and the outer ends of the coil units project alternately into the inner and the outer vertical passages 20 and 22, while the remaining structure is substantially same as the winding assembly shown in FIG. 1. With the arrangement of the coolant passages shown in FIG. 5 the flow of coolant is throttled by the restriction defined between the inner ends of the coil units 10 projecting into the inner vertical passage 20 and the inner wall of the inner cylinder 14 as well as between the outer ends of the coil units 10 projecting into the outer vertical passage 22 and the inner wall of the outer cylinder 16, as a result of which a high fluid pressure will prevail in the regions under the projecting end portions of the coil units, while a low fluid pressure will prevail in the region over the projecting and portions of the coil units because the cross-section of the vertical passages is enlarged at the regions located over the projecting end portions of the coil units. Thus, there is produced pressure difference between the outlet and the inlet ports of the individual horizontal passages 18. Under such pressure difference and additional drag action due to viscosity of the coolant, there is induced flows of the coolant in the horizontal passages 18 as indicated by arrows.

The winding structure described above has however a drawback that, in the event of short-circuit fault of the winding assembly, the electric field is concentrated on the projecting ends of the danger coil units thereby exposing the winding structure to the danger of being destroyed, since the ends of the coil units 10 are alternately projected and offset for each pitch of the winding. If the mechanical strength of the winding assembly is to be increased so as to protect against such destruction, the volume or bulk of the winding assembly has to be necessarily increased. A more improved cooling effect may be attained by increasing the projection and the offset of the coil units. However, then flow sectional area of the inner and the outer vertical coolant passages 20 and 22 at the restrictions will become considerably small, whereby the coolant flow is turned in the flowing directions at each of the coil units, involving an increased flow resistant and pressure loss. Accordingly, if the cooling effect of the winding assembly is attempted to be enhanced by increasing the flow rate of the coolant in the horizontal passages 18 while suppressing the flow resistance or pressure loss to a reasonable degree, the winding structure will become volumious thereby making it impossible to obtain a miniaturized and a light weight structure of the winding assembly or the structure of a large capacity.

Figure 6:
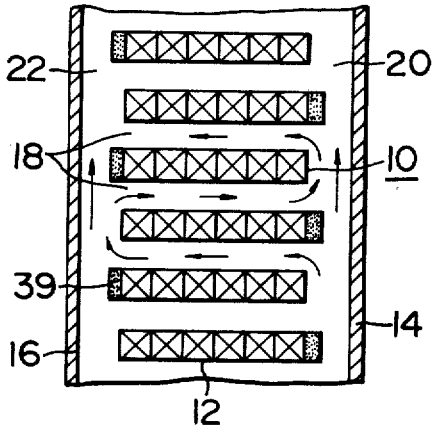
FIG. 6 PRIOR ART

Daikoku et al. among the inventors of the present application developed a winding structure shown in FIG. 6 as an improvement of the structure shown in FIG. 5, which winding structure is described in commonly assigned U.S. patent application Ser. No. 880,422, now U.S. Pat. No. 4,207,550, filed Feb. 23, 1978 under the title "Winding Structure of Electric Devices". In the case of the winding structure, the end portions of the individual coil units 10 are radially projected alternately for each pitch of the coil units. In contrast thereto, the coil units 10 of the winding structure shown in FIG. 6 are alternately provided with outer and inner annular flow control members 39 of a uniform thickness or projection depth in the radial direction of the winding thereby to decrease and increase the flow sections of the inner and the vertical flow passages 20 and 22 alternately for each pitch of the coil units 10. With such arrangement of the coolant passages, the coolant flow can be induced in the horizontal cooling passages 18 for the similar reasons described hereinbefore in conjunction with FIG. 5. In this connection, it is to be noted that the flow control members 39 are made of an electrically insulating material. As is well known, a body projecting into a flow of coolant is far better cooled as compared with a non-projecting body. Further, an electric insulation material has a very low thermal conductivity as compared with the winding conductors 12. Accordingly, in the case of the winding structure shown in FIG. 6, the inherently very high cooling effect at the projecting flow control members 39 is cancelled out by the poor thermal conductivity of the flow control members 39, whereby the overall cooling efficiency of the coil units 10 is dimenished.

In order to enhance the cooling effect, the flow control member 39 may be enlarged in its radial thickness to increase the misalignment among the side ends of the coil units. However, the increased thickness of the flow control member 39 will result in a correspondingly decreased flow cross-section of the inner and the outer vertical coolant passages 20 and 22 and the flow turns for each of the coil units 10, involving a high flow resistance and pressure loss.

When the radial thickness of the flow control member 39 is reduced, the flow rate and hence the cooling effect may be somewhat improved. However, this will result in a stagnation of flow or low flow rate in the horizontal coolant passages.

From the foregoing description, it will be appreciated that the attempts to increase the coolant flow rate in the horizontal passages while suppressing the flow loss to an acceptable minimum have encountered difficulty in attaining a winding assembly of a small size and a light weight or in implementing a winding assembly of a large capacity.

With the invention, it is contemplated to eliminate the disadvantages of the prior known or proposed winding structures described above.

Figure 7:
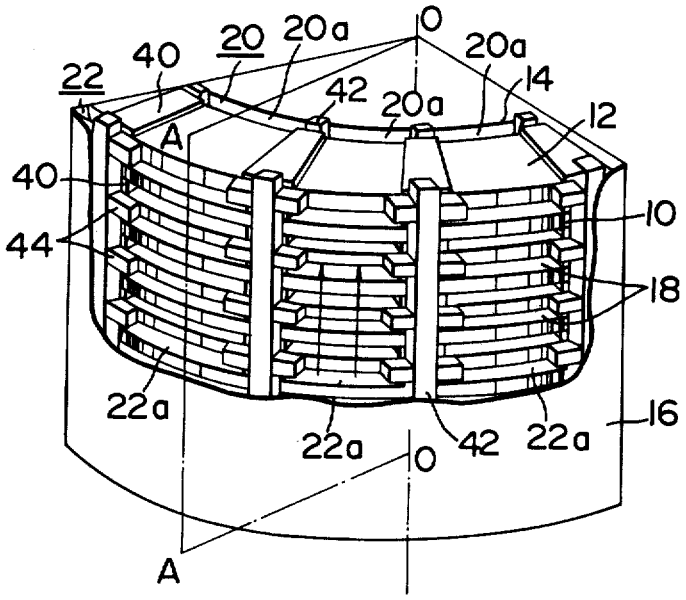
FIG. 7 is a fragmental perspective view showing a main portion of an annular winding structure for a transformer according to an embodiment of the invention.

Now, the invention will be described with reference to FIGS. 7 et seq., in which the components or members as correspond to those shown in FIGS. 1 to 6 are denoted by the same reference numerals. FIG. 7 shows an exemplary embodiment of the invention which is applied to a transformer, a typical example of the static induction apparatus. The winding assembly for the transformer comprises an inner cylinder 14 and an outer cylinder 16 between which a plurality of the annular disk-like coil units 10 each constituted by the wound conductors 12 are disposed in a substantially vertical alignment in the axial direction. Horizontal coolant passages 18 are formed each between the adjacent coil units 10 which are spaced from one another in the axial or vertical direction by means of horizontal spacers 40, while an inner vertical coolant passage 20 is defined between the inner ends of the coil units and the inner cylinder 16 by a plurality of upstanding vertical spacers 42 disposed along the inner periphery of the winding and in a similar manner an outer coolant passage 22 is defined between the outer ends of the coil units 10 and the outer cylinder 16 by a plurality of the vertical or column spacers 42 disposed along the outer periphery of the winding. The baffle plates (32 and 34 in FIG. 4) used in the hitherto known winding structures for forming cooling segments or zones for several coil units to cause the coolant flows in the zig-zag pattern are omitted. Instead thereof, flow control members 44 are disposed only in the outer vertical passage 22 for every other coil unit or each for two axial pitches of the coil units 10 substantially oppositely to the outer ends of the associated coil units, whereby the arcuate width of the individual outer vertical coolant passage 22 in the circumferential direction is alternately increased and decreased for each axial pitch of the coil units 10. In other words, the cross-sectional area of the outer vertical coolant passages 22 as taken in the direction perpendicular to the axial direction, i.e. in the radial direction is sequentially and alternately increased and decreased for each axial pitch of the coil units 10.

In the above description, each of the inner and the outer vertical passages has been assumed to be a single integral passage of a substantially cylindrical configuration, respectively. However, in actuality, these inner and outer vertical passages may be considered as being divided into a plurality of inner vertical passage segments 20*a* and outer vertical passage segments 22*a* by means of the upstanding vertical spacers 42. In this sense, it can be said that, in the case of the winding structure shown in FIG. 7, the circumferential width of the individual vertical passage segments 22*a* is so narrowed that the cross-sectional area of the vertical passage segments in the horizontal direction is alternately increased and decreased for the coil units 10 with the axial pitch thereof as viewed in the axial direction.

The flow control member 44 may be formed of an electrical insulation material such as press board or the like and supported through engagement with suitable components of the winding structure such as the horizontal and/or vertical spacer members 40; 42 or bonding thereto by a bonding agent.

Although the flow control members 44 are disposed only in the outer vertical coolant passage 22 in the case of the winding structure shown in FIG. 7, they may be disposed only in the inner vertical coolant passage 20 or in both of the inner and the outer vertical passages 20 and 22, as will be described more fully hereinafter.

Figure 8:
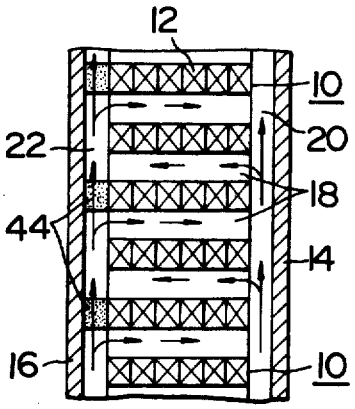
FIG. 8 is a schematic vertical sectional view taken along the plane OAAO in FIG. 7.

With the arrangement of the flow control members disposed at least in one of the inner and the outer vertical coolant passages such as the outer passage 22 as shown in FIG. 7 for every other coil units 10 in opposition to the outer ends of the associated coil units 10 thereby to enlarge and shorten alternately the circumferential width of the outer vertical passage 22 for each of the coil units, there will be produced flow of coolant within the winding structure as represented by arrows in FIGS. 7 and 8, the latter figure showing a vertical section taken along the plane OAAO in FIG. 7.

Now, description will be made in detail on the coolant flows in the winding structure with the aids of FIGS. 7 and 8, when the cooling medium or coolant flows within the outer vertical passage 22 upwardly as indicated by the arrows, a high fluid pressure will be produced below the flow control members 44 due to the narrowing or restriction of the horizontal cross-sectional area of the outer vertical coolant passage 22 as provided by the flow control members 44, whereby the coolant is caused to flow through the horizontal coolant passages 18 under the high fluid pressure in the inward direction as indicated by the arrows. Since the velocity or the flow rate of the coolant having passed through the portion of the vertical passage 22 narrowed by the flow control member 44 is increased, the fluid pressure is low at the region above the flow control member 44, as a result of which the coolant flow in the outward direction is induced in the horizontal passage 18 located over the coil unit having the flow control member 44 under suction effect. These coolant flows induced in the horizontal passages 18 in the inward and outward directions are, after having cooled the associated coil units 18, mixed with the major coolant flows in the inner and the outer vertical passages to dissipate heat. Such cooling cycle is repeated.

In this manner, the plurality of the coil units 10 disposed between the inner and the outer cylinders 14 and 16 are effectively and uniformly cooled by the coolant flows in the inner and the outer vertical passages 20 and 22 as well as the horizontal coolant flows produced by the flow control members 44. Further, by virtue of the fact that the direction of the coolant flow in the horizontal passage 18 located over a given one of the coil units is opposite to the flow direction of the coolant in the horizontal passage underlying the given coil unit, the uniform cooling of the coil unit 10 can be attained.

Figure 9:
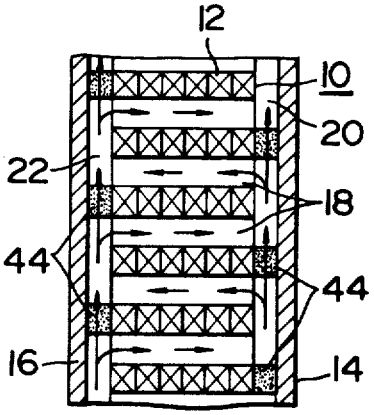
FIG. 9 is a schematic vertical sectional view of a winding structure for a transformer according to another embodiment of the invention.

FIG. 9 shows another embodiment of the invention which differs from the arrangement shown in FIGS. 7 and 8 in that the flow control members 44 are disposed in both of the inner and the outer vertical passages 20 and 22 substantially oppositely to the ends of the every other coil units 10 in a zig-zag or stagged pattern with respect to the inner and outer vertical passages 20 and 22 thereby to alternatively increase and decrease the outer and inner circumferential widths of the vertical passages 20 and 22 for each of the coil units 10. More specifically, when the flow control member 44 is provided in the inner vertical coolant passage 20 substantially oppositely to the inner end of a certain coil unit 10, then two coil units 10 disposed, respectively, over and under the certain coil unit 10 through the interposition of the respective horizontal flow passages 18 are provided with the outer flow control members 44 positioned in the outer vertical flow passage 22 substantially oppositely to the outer ends of the two coil units 10. Such alternate array of the flow control members 44 are repeated for all the coil units 10. With the arrangement of the flow passages shown in FIG. 9, the coolant flow and hence the cooling effect can be improved over those attained in the structure shown in FIGS. 7 and 8.

Figure 10:
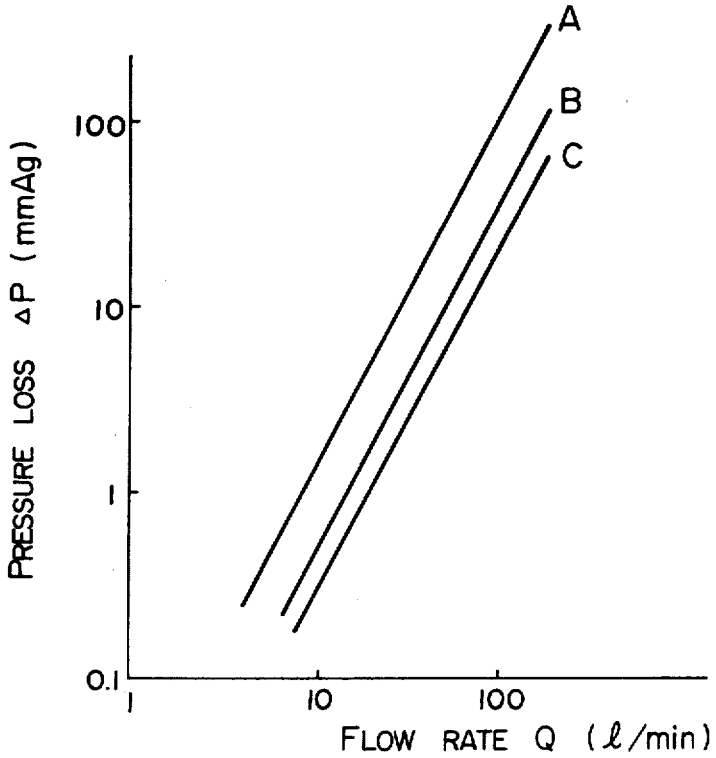
FIG. 10 is to graphically illustrate fluid pressure loss characteristics of coolant flows.

Experiments have been conducted on the winding structure shown in FIG. 9 in comparison with the hitherto known winding structures using the flow deflection plates shown in FIG. 4 and the structure having the coil units deviated alternately in the opposite radial directions by one pitch of the coil units as shown in FIG. 5. Results of the experiments are illustrated in FIG. 10 which shows logarithmic graphs representing loss characteristic, i.e. the relation between the flow rate Q of the coolant and the pressure loss ΔP for the above three winding structures. The winding as used in the experimental measurement included nine coil units each having a radial width of 100 mm, axial height or thickness of 15 mm with the height of the horizontal coolant passage (space between the adjacent coil units) being 10 mm, while the distance between the inner and the outer cylinders was selected at 130 mm. In the case of the winding structure shown in FIG. 9, the radial width of each of the inner and the outer vertical passage segments (20*a*, 22*a*) was selected to be 15 mm. The respective circumferential lengths of each of the inner and outer vertical passage segments (20*a*, 22*a*), namely the circumferential distance between the opposing surfaces of the two adjacent vertical spacers defining each passage segment, were selected to be 90 mm and 110 mm, respectively. The flow control members 44 were circumferentially projected into each of the inner and outer vertical passage segments (20*a*, 22*a*) by 13.5 mm and 16.5 mm, respectively, from the opposing surfaces of the two adjacent vertical spacers of the respective segments (20*a*, 22*a*) so that the respective circumferential length were periodically reduced to be 63 mm and 77 mm, respectively.

In the case of the prior known structure shown in FIG. 4, the radial width and the circumferential width of each of the inner and outer vertical passages was selected to be the same dimensions as those of the winding structure of the above-mentioned case of FIG. 9. The baffle plates were interposed for every ninth coil units.

In the known winding structure of FIG. 5, the coil units were deviated or offset from one another alternately by 5 mm in the radial direction, while the radial width of the inner and the outer vertical passage segments (having the same circumferential width as that of the case of FIG. 9) were changed from 17.5 mm to 12.5 mm for each of the coil units.

In FIG. 10, the curve A and B represent the characteristics of the known winding structures shown in FIGS. 4 and 5, respectively, while the curve C represents the characteristic of the winding structure shown in FIG. 9 in which the flow control members 44 projects into the inner and the outer vertical coolant passages by 13.5 mm and 16.5 mm, respectively, from each of the opposing surfaces of the vertical spacer of each of the inner and outer vertical passage segments. In the case of the structure according to the present invention, the pressure loss at the same flow rate is decreased to about one-fifth of that of the known structure shown in FIG. 4 and about one half of that of the winding structure shown in FIG. 5. When a same pressure difference is maintained between the inlet and the outlet of the coolant flow, the flow rate in the winding structure shown in FIG. 9 is about 3.5 times as high as that of the structure shown in FIG. 4 and about 1.7 times as high as that of the structure shown in FIG. 5.

Figure 11:
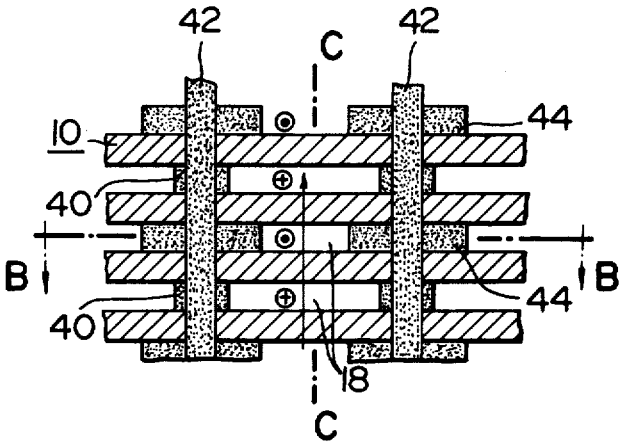
FIG. 11 is a schematic vertical sectional view showing another embodiment of the winding structure for a transformer according to the invention.
Figure 12:
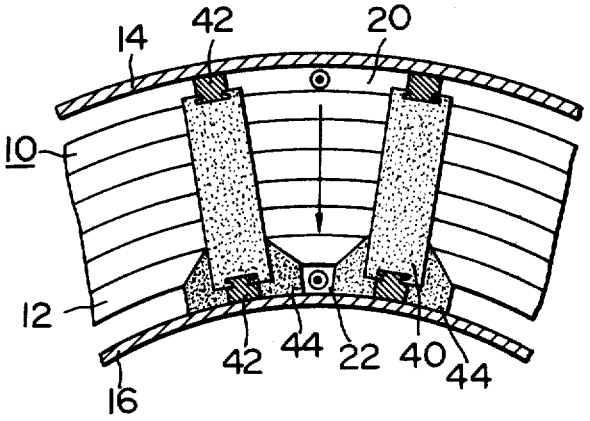
FIG. 12 is a cross-sectional view taken along the line B—B in FIG. 11.
Figure 13:
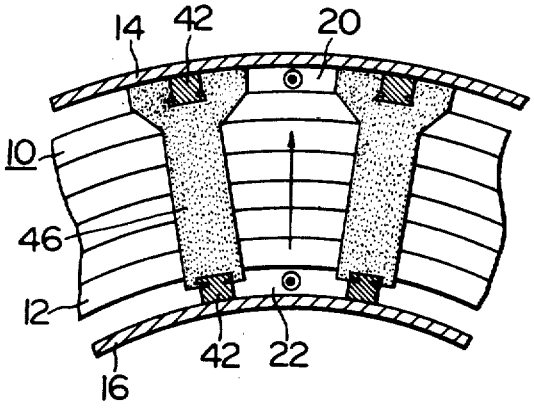
FIG. 13 is a view similar to FIG. 12 and shows a modification of the structure shown therein.
Figure 14:
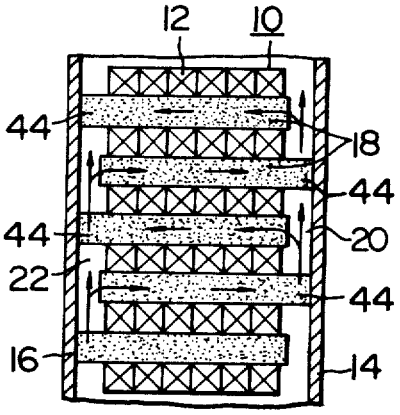
FIG. 14 is a vertical sectional view taken along the line C—C in FIG. 11.

FIGS. 11 to 14 show another embodiment of the invention in which the flow control members 44 are disposed in the inner and the outer vertical coolant passages 20 and 22 in opposition to the horizontal spacers 40 in the alternate sequence for every other one of the coil units 10 and supported through geometrical engagement with the horizontal or vertical spacers 40 and 42 or alternatively through bonding thereto. The remaining structure is same as the winding assembly shown in FIG. 7. FIG. 11 is a fragmental front view of the winding structure, while FIG. 12 is a sectional view taken along the line B—B in FIG. 11 and shows a geometrical engagement of the flow control members 44 with the horizontal and the vertical spacers 40 and 42. FIG. 13 is a similar sectional view as FIG. 12 but shows the flow control members which are each formed integrally with the horizontal spacer and denoted generally by the reference numeral 46. FIG. 14 shows a cross-section taken along the line C—C in FIG. 11.

In the winding structures shown in FIGS. 11 to 14, the coolant will flow from the bottom toward the top. When the coolant passes through the passage region narrowed or restricted by the flow control member 44, the velocity of the coolant flow is increased with the fluid pressure at the narrowed region becoming low, as a result of which the coolant in the horizontal passage 18 opened in the narrowed region will flow in the direction toward such region under suction effect, as indicated by arrows. On the other hand, when the coolant flows in the wider vertical passage region after having passed through the restricted region, the velocity of the coolant flow is decreased thereby to increase the fluid pressure at the wider region. Thus, there will be induced in the horizontal passage 18 opened in such water region of the vertical flow passage the coolant flow in the direction opposite to the wider passage region under the backing pressure. The coolant flows within the horizontal passages 18 in the opposite directions are, after having cooled the associated coil units 10, added to the major flows within the inner and the outer vertical coolant passages 20 and 22 to dissipate heat therein, such cooling cycle being repeated as is in the case of the structure shown in FIG. 9.

Figure 15:
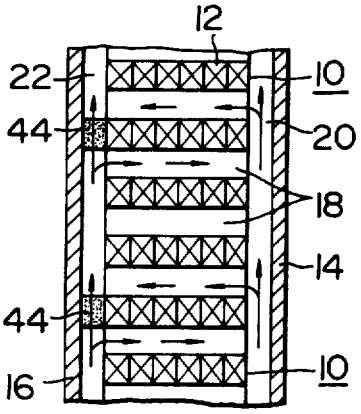
FIG. 15 is a schematic vertical sectional view showing a modification of the structure of FIG. 8.
Figure 16:
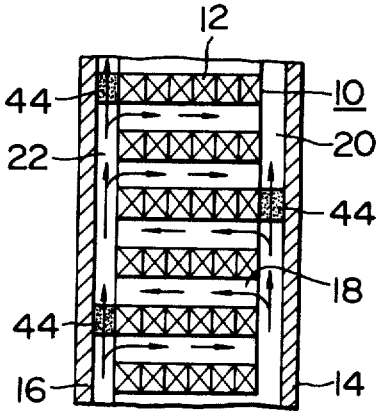
FIG. 16 is a schematic vertical sectional view showing a modification of the winding structure of FIG. 9.

In the winding structures described above, the pitch of the flow control members in the axial direction is selected twice as great as the vertical pitch P of the coil units 10, i.e. at 2P. However, the vertical pitch of the flow control members may be selected at other values. For example, in the case of the modification shown in FIG. 15, the vertical pitch of the flow control member 44 is selected at 3P, while in the structure shown in FIG. 16, the vertical pitch is selected at 4P to the substantially same effect.

Figure 17:
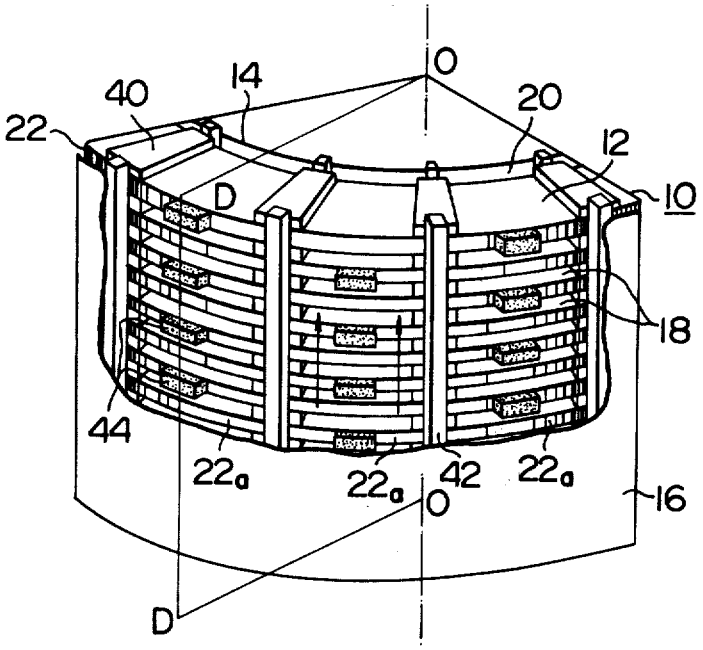
FIG. 17 is a fragmental perspective view showing a main portion of an annular winding structure for a transformer according to another embodiment of the invention.
Figure 18:
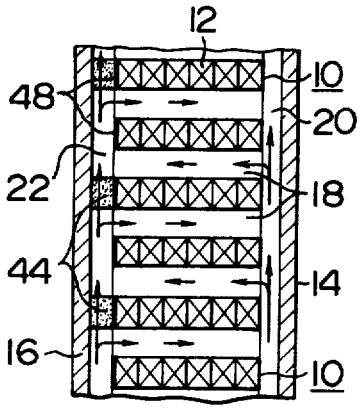
FIG. 18 is a schematic vertical sectional view taken along the plane ODDO in FIG. 17.

FIGS. 17 and 18 show another winding structure according to the invention which differs from the winding assemblies shown in FIGS. 7 to 16 essentially in that the flow control members 44 are neither engaged nor contacted with the vertical spacers 42 and the horizontal spacers 40 but disposed at intermediate portion between the adjacent upstanding vertical spacers 42. More particularly, the flow control members are positioned at a middle portion of every vertical coolant passage segment 22*a* constituting the outer vertical coolant passage 22. By the way, FIG. 18 is a vertical sectional view taken along the plane ODDO in FIG. 17. Except for the difference in respect to the location of the flow control members 44, the remaining structure is same as the one shown in FIG. 7. Accordingly, further description will be unnecessary. It is however to be mentioned that the positions of the flow control members 44 in the adjacent vertical passage segments should preferably be staggered in the horizontal direction. In the individual outer vertical passage segments 22*a*, the flow control members 44 are disposed at the middle portion for every other coil units 10 or with the pitch twice as great as the latter substantially oppositely to the outer ends of the associated coil units 10, thereby to vary the flow sectional area of the individual outer vertical passage segments 22a for each vertical pitch of the coil units 10.

The flow control member 44 may be formed of an electrical insulation material such as a press board. The mounting of the flow control members 44 onto the coil unit 10 may be carried out by first bonding the flow control members 44 onto a band 48 of an electrical insulation material such as a press board, for example, and having a width corresponding to the vertical thickness of the flow control member and then securing the band 48 around the coil unit 10.

In the case of the structure shown in FIGS. 17 and 18, the flow control members 44 are disposed only in the outer vertical coolant passage 22. However, they may be disposed only in the inner vertical coolant passage 20 or alternatively in both of the inner and the outer vertical coolant passages 20 and 22, as will described more fully hereinafter.

With the structure shown in FIGS. 17 and 18 in which the flow control members 44 are disposed in the outer vertical coolant passage 22 for every other coil unit 10 substantially oppositely thereto for decreasing the flow cross-section of the outer vertical passage segments 22a at a vertical pitch twice as great as that of the coil units, the coolant flows such as indicated by arrows in FIGS. 17 and 18 can be induced, whereby substantially same action and effect as those described in conjunction with FIGS. 7 and 8 can be obtained.

Figure 19:
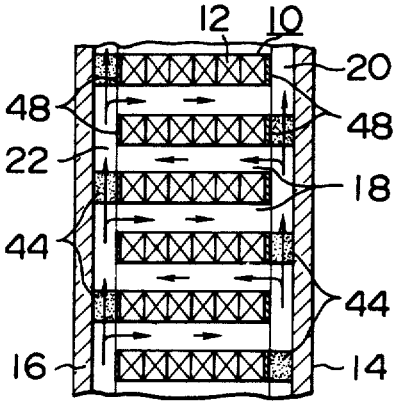
FIG. 19 is a schematic vertical sectional view showing a winding structure for a transformer according to still another embodiment of the invention.

FIG. 19 shows a modification of the winding structure shown in FIGS. 17 and 18 which is intended for further enhancing the cooling action. To this end, the flow control members 44 are disposed in both the inner and the outer vertical coolant passages 20 and 22 at alternately staggered vertical positions substantially oppositely to the alternate ones of the coil units 10, thereby to decrease alternately the flow sections of the inner and the outer vertical passage segments 20a and 20b for each of the coil units 10. More specifically, when one given flow control member 44 is disposed substantially in opposition to the inner end of a certain coil unit 10 in a certain inner vertical coolant passage segment 20a, then the flow control members 44 are provided each for the coil units 10 disposed adjacent to the certain coil unit 10 in the outer vertical coolant passage segment 22a through interposition of the associated horizontal passages 18 at positions substantially opposite to the outer ends of the respective coil units 10 and such alternate array of the flow control members is repeated. By virtue of the structure in which the flow cross-sections of the inner and the outer vertical passage segments 20a and 22a are alternately decreased for each of the coil units 10, the coolant is allowed to flow in the improved state within the upper and lower horizontal passages 18 of the individual coil units 10, which in turn will result in a much enhanced cooling action as compared with that of the structure shown in FIGS. 17 and 18. It will be noted that the embodiment shown in FIG. 19 corresponds to the winding structure shown in FIG. 9.

Experiments were conducted on the winding structure shown in FIG. 19 in comparison with the prior known structures described hereinbefore in conjunction with FIGS. 4 and 5 while the same dimensions as those employed in the experiment on the winding structure shown in FIG. 9. It has been found that substantially the same results as those illustrated in FIG. 10 are obtained in respect of the characteristic relation between the flow rate Q and the fluid pressure loss $\Delta P$.

Figure 20:
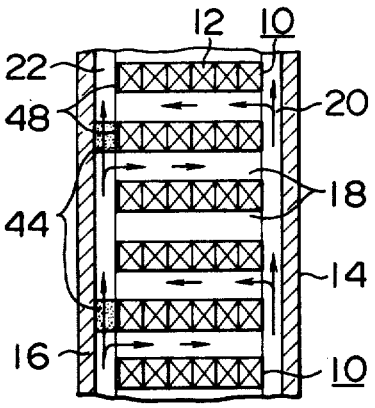
FIG. 20 is a schematic vertical sectional view showing a modification of the structure shown in FIG. 18.
Figure 21:
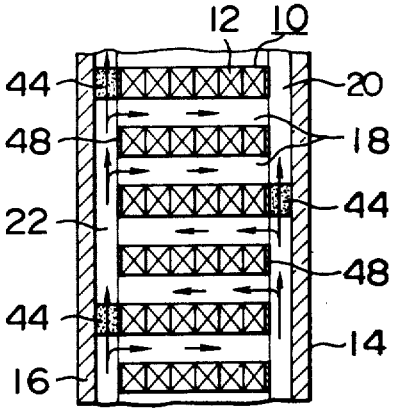
FIG. 21 is a schematic vertical sectional view showing a modification of the structure shown in FIG. 19.

In the case of the winding structures shown in FIGS. 17 to 19, the pitch of the flow control members 44 in the vertical direction is selected at twice as great as the vertical pitch P of the coil units 10, i.e. 2P. However, it is possible to employ other values of the pitch. For example, in the case of the structure shown in FIG. 20, the vertical pitch of the flow control members 44 is selected at 3P, while the pitch equal to 4P is selected in the winding structure shown in FIG. 21 to the substantially similar effect.

Figure 22:
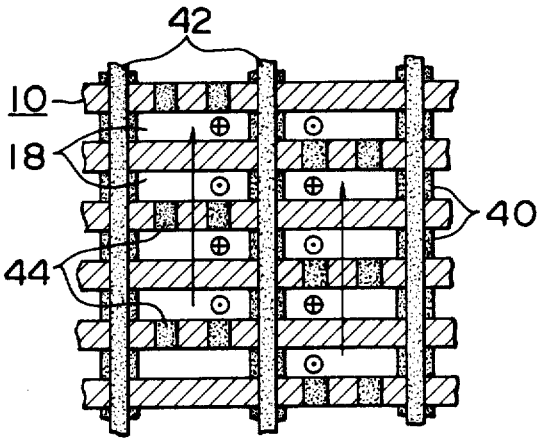
FIGS. 22, 23, 24 and 25 are schematic front views showing further winding structure according to the invention.

Although only one vertical array of the flow control members 44 is provided for each of the inner and the outer vertical flow segments 20a and 22a. it is also possible to provide two or more vertical arrays of the flow control members 44 for each of the passage segments 20a and 22a as shown in FIG. 22, so far as the fluid pressure loss can be maintained within an acceptable limit.

Figure 23:
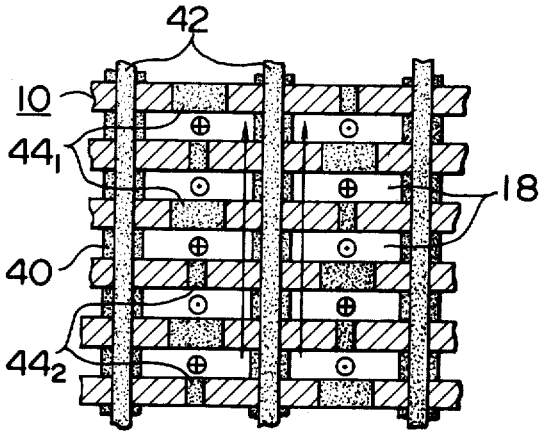

Further, as shown in FIG. 23, it is possible to provide the flow control member 44 for each of the coil units 10 with the circumferential width of the flow control members in one vertical array being different alternately, such as longer members $44_1$ and shorter members $44_2$, and in a horizontally staggered relation relative to those of the adjacent vertical passage segments.

Figure 24:
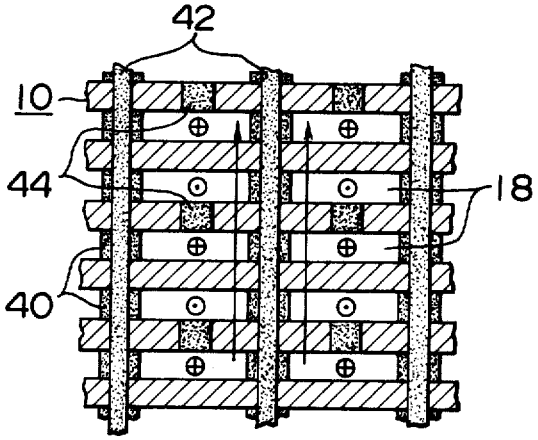

In the case of the winding structures shown in FIGS. 17 to 23, the horizontal positions of the flow control members 44 in the vertical array thereof are staggered relative to those disposed in the adjacent vertical passage segments 20a and 22a. However, it is possible to provide the flow control members 44 on the same coil units in the adjacent vertical passage segments 20a and 22a, as is shown in FIG. 24. Not only in view of each of the vertical coolant passage segments 20a and 22a but also in view of each of the respective inner and outer vertical coolant passages, the arrangement of the flow control members 44 of FIG. 24 meets the requirement of the invention that the flow cross-section of the vertical coolant passage is decreased for every distance of nP where n is an integer which is not smaller than 2 and P represents the axial pitch of the coil units constituting the winding.

Although the flow control members in the winding structures shown in FIGS. 17 to 24 are aligned with each other in the axial or vertical direction, it is also possible to dispose the flow control members 44 at deviated positions in the horizontal or circumferential direction.

Figure 25:
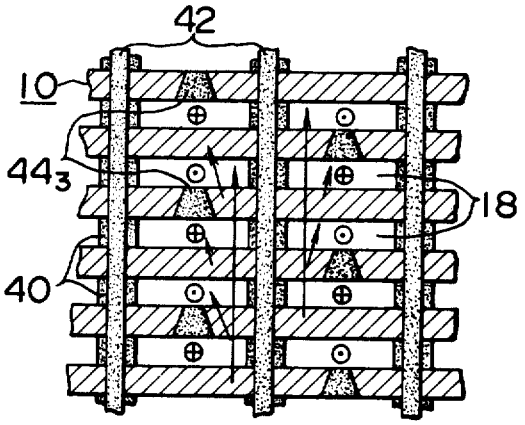

In the case of the winding structures shown in FIGS. 17 to 24, it has been assumed that each of the flow control members 44 has a substantially constant cross-section in the axial or vertical direction as viewed in a plane orthogonal to the axis of the winding. In contrast thereto, FIG. 25 shows another embodiment of the invention in which the cross-sectional area of the flow control member 44 in a plane perpendicular to the axis of the winding decreases in the direction of the flow of coolant. In other words, the flow control member $44_3$ shown in FIG. 25 has a triangular or trapezoidal cross-section as viewed in a plan parallel to the circumferential direction of the winding. When the flow control members $44_3$ having such cross-sectional shape are disposed in the similar arrangement as that of FIG. 17, the coolant flowing through the vertical coolant passage will tend to flow in the directions slanted to the axis of the winding along the correspondingly inclined side surfaces of the flow control member $44_3$. Thus, the coolant having passed by a certain flow control member $44_3$ in the outer vertical passage 22, for example, will impinge against the wide bottom surface of the succeeding flow control member disposed at the downstream side of the former, as a result of which a higher backing pressure will be produced to divert the coolant flow into the horizontal passage 18.

Figure 26:
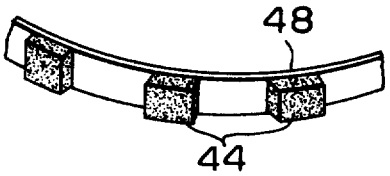
FIGS. 26, 27 and 28 are fragmental perspective views showing mounting band members for mounting flow control members in the winding structures according to the teachings of the invention.

For mounting the flow control members 44 in the winding structures shown in FIGS. 17 to 25, the flow control members 44 each having a radial thickness substantially equal to the radial width of the vertical coolant passages 20 and 22 are first bonded to a band 48 having a width substantially equal to the axial thickness or hight of the coil unit 10 with a circumferential pitch equal to mPv where m is an integer which is not smaller than one (1) and Pv represents the circumferential pitch of the vertical coolant passage segments, as is shown in FIG. 26. Thereafter, the band 48 is secured around at least one of the inner and the outer circumferences of the coil unit 10 so that the flow control member 44 may be positioned at the mid portion of the inner or outer vertical coolant passage segments 20*a* or 22*a* with an axial pitch lP where l is an integer which is not smaller than one (1) and P represents the axial pitch of the coil units.

The flow control member 44 and the belt 48 may be made of an electrical insulation material such as a press board. The width of the band 48 should not exceed the thickness of the coil unit 10, while thickness of the band 48 should preferably be made thiner so far as the strength to allow the band to be secured around the coil unit 10 can be obtained. The radial thickness of the flow control member 44 should be slightly smaller than or substantially equal to the radial width of the vertical coolant passages. The height or length of the flow control member 44 in the axial or vertical direction may be made smaller than the width of the mounting band 48.

In the case of the winding structure shown in FIGS. 17 and 18, the flow control members 44 are mounted on the band 48 at two circumferential pitches of the outer vertical passage segment, while in the case of the winding structure shown in FIG. 24, the flow control members 44 are mounted on the band 48 at one circumferential pitch of the outer vertical passage segment. In the structure shown in FIG. 22, a pair of the flow control members 44 located at the same vertical or axial position in the vertical passage segment are mounted on the band 48 at two circumferential pitches of the vertical passage segment.

Figure 27:
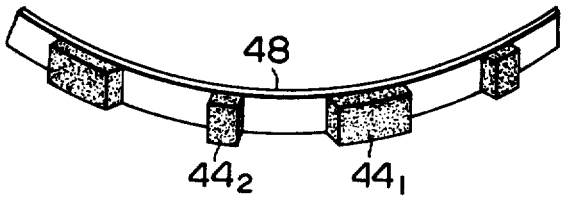
Figure 28:
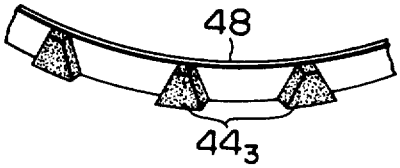

The mounting band 48 having the flow control members $44_1$ and $44_2$ of different widths in the circumferential direction as shown in FIG. 27 is intended to be used in the winding structure such as shown in FIG. 23, while the band 48 having bonded thereto the trapezoidal flow control members $44_3$ as shown in FIG. 28 is intended to be used in the winding structure such as shown in FIG. 25.

Figure 29:
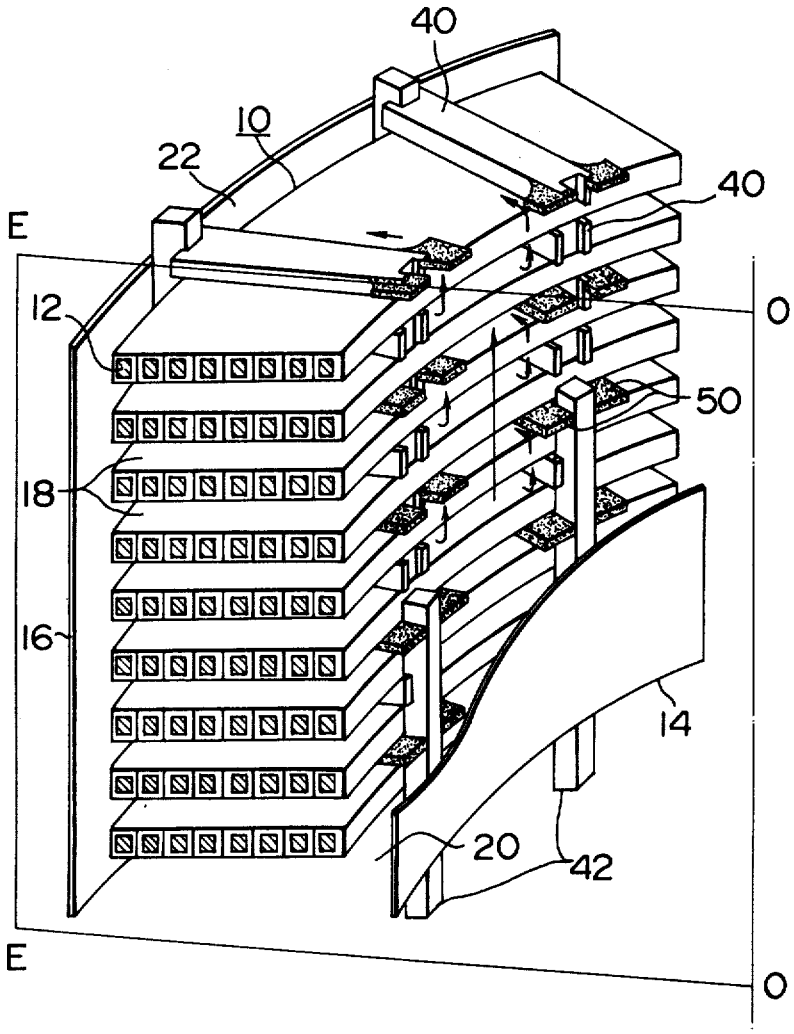
FIG. 29 is a fragmental perspective view showing a main portion of a winding structure for a transformer according to another embodiment of the invention.
Figure 30:
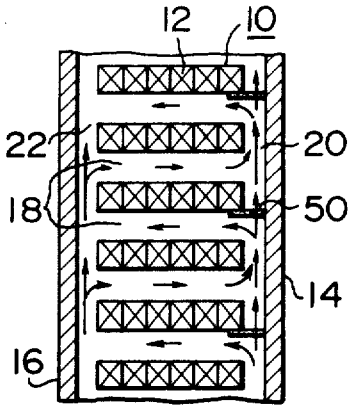
FIG. 30 is a schematic vertical sectional view taken along the plane OEEO in FIG. 29.

FIGS. 29 and 30 show another embodiment of the invention which differs from the winding structure shown in FIG. 7 in that flow control plates 50 are provided. By the way, FIG. 30 is a vertical sectional view taken along the plane OEEO in FIG. 29.

The flow control plates 50 are disposed within the inner vertical coolant passage 20 for every other horizontal spacers 40, i.e. at two pitch of the horizontal spacers 40 as viewed in the horizontal direction and positioned substantially oppositely to the associated horizontal spacers, thereby to decrease the circumferential width of the inner vertical coolant passage 20 at two pitches of the horizontal spacers in the axial direction of the winding. The flow control plate 50 is made thinner than the horizontal spacer 40 and so positioned that the top surface of the plate 50 be flush with the top surface of the horizontal spacer 40 in the case of the winding structure for a transformer shown in FIG. 29.

The flow control plate 50 may be made of an electrical insulation material such as a press board and secured to the opposite end portion of the associated horizontal spacer 40.

The winding structure shown in FIGS. 29 and 30 corresponds to the one shown in FIGS. 7 and 8 and exhibit the substantially same cooling effect as that of the latter.

Figure 31:
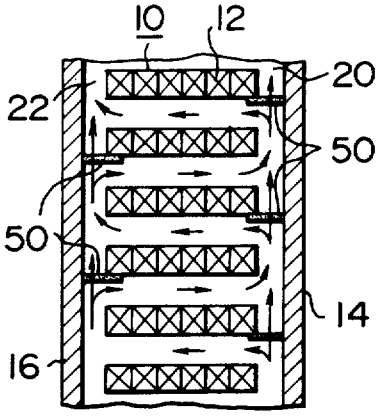
FIG. 31 is a schematic vertical sectional view showing still another winding structure for a transformer according to the invention.

FIG. 31 shows a modification of the winding structure shown in FIGS. 29 and 30 which is so designed as to further enhance the cooling effect. To this end, the flow control plates 50 are disposed in both of the inner and the outer vertical flow passages 20 and 22 so as to be positioned alternately in these passages in the vertical or axial direction for every other horizontal spacers 40 in the axial direction, thereby to decrease the circumferential widths of the inner and the outer vertical coolant passages 20 and 22 alternately with one axial pitch of the horizontal spacers. More specifically, when a certain horizontal spacer is provided with the flow control plate 50 disposed in the inner vertical coolant passage 20, then the horizontal spacers positioned adjacent to the certain horizontal spacer through the interposed coil unit are provided with the respective flow control plates 50 which are however disposed in the outer vertical coolant passage 22. Such alternate array of the flow control plate 50 is repeated. With the arrangement of the flow control plates to decrease alternately the circumferential width of the inner and the outer vertical coolant passages 20 and 22 for each of the horizontal spacers, the conditions for the coolant flows above and below the individual coil units 10 are improved over that of the winding structure illustrated in FIGS. 29 and 30, whereby an enhanced cooling effect onto the coil units 10 can be accomplished.

The winding structure shown in FIG. 31 corresponds to the one shown in FIG. 9.

Flow experiments were conducted on the winding structure shown in FIG. 29 in comparison with the prior known structures shown in FIGS. 4 and 5 in order to determine the characteristic relation between the flow rate Q of the coolant and the flow pressure loss $\Delta P$. It has been found that substantially the same results as those illustrated in FIG. 10 have been obtained. The dimensions of the known structures shown in FIGS. 4 and 5 were same as those adapted in the experiment made on the winding structure shown in FIG. 9, while in the case of the winding structure shown in FIGS. 29 and 30, there were disposed in the inner and outer vertical coolant passages having the same radial width and circumferential width as those of the previous experiment case of FIG. 9. The thickness of the flow control plate was selected to be 1.6 mm and the circumferential width of the same was selected such that the respective circumferential width of each of the inner and outer passage segments were periodically narrowed by 27 mm and 33 mm respectively. Namely, the flow control plates 50 were circumferentially projected into each inner passage segment by 13.5 mm and into each outer passage segment by 16.5 mm from each of the opposing surfaces of the two adjacent vertical spacers in each of the inner and outer vertical passage segments, respectively. The flow control plates 50 were disposed in a staggered relation in the vertical direction with respect to any and every two radially adjacent two inner and outer vertical passage segments opposing to each other through the winding assembly. The winding structure of this embodiment of FIGS. 29 and 30 is the same in dimension as those of the cases of FIGS. 4 and 5.

Figure 32:
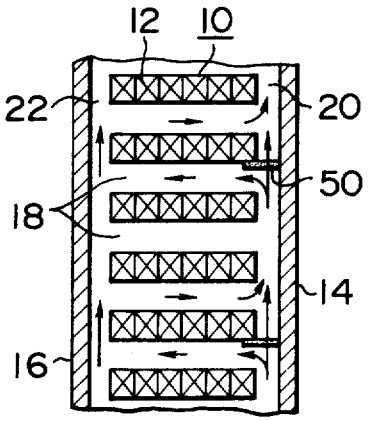
FIG. 32 is a schematic vertical sectional view showing a modification of the winding structure shown in FIG. 30.
Figure 33:
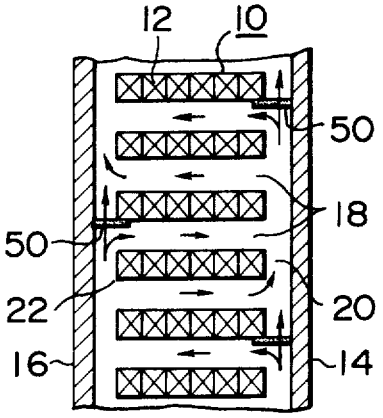
FIG. 33 is a schematic vertical sectional view showing a modification of the winding structure shown in FIG. 31.

Although the pitch of the flow control plates in the axial direction of the winding structure shown in FIGS. 29, 30 and 31 is selected at twice as great as the axial pitch of the horizontal spacers and hence the axial pitch P of the coil units 10, it is also possible to select the axial pitch of the flow control plates at 3P as is in the case of the structure shown in FIG. 32 and at 4P in the winding structure shown in FIG. 33 or other values within a reasonable range to substantially the same cooling effect.

Figure 34:
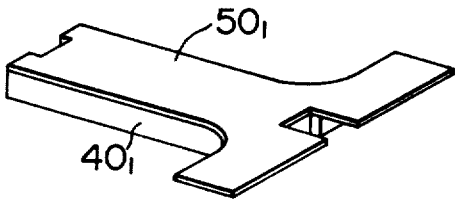
FIGS. 34 and 35 are perspective views showing exemplary embodiments of flow control members as employed in the winding structures according to the invention.
Figure 35:
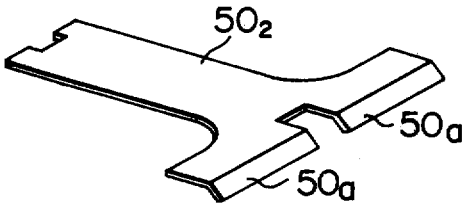

FIGS. 34 and 35 show other possible embodiments of the flow control plate 50 adapted to be used in the winding structures according to the invention. FIG. 34 shows the flow control plate $50_1$ which is formed integrally with the horizontal spacer $40_1$ in a superposed structure and has a width equal to the space between the adjacent coil units 10 as a whole. In the case of the flow control plate $50_2$ shown in FIG. 35 which is also formed integrally with the horizontal spacer $40_1$, a projecting edge portion $50_a$ is bent along the circumference of the coil unit 10 in the direction opposite to that of the coolant flow. With such structure of the flow control plate $50_2$, the contact with the inner and the outer cylinders 14 and 16 is improved, whereby a relatively large tolerance is allowed for the radial length of the flow control plate $50_2$ in the manufacture thereof. Further, since the radial length of the flow control plate $50_2$ is greater than the width of the inner or outer vertical coolant passage, the flow control plate $50_2$ will not be easily bent by the coolant flow due to an increased mechanical strength of the bent plate $50_2$.

The flow control members as well as the flow control plates described in the foregoing are not necessarily disposed throughout the whole length of the vertical coolant passages of the winding structures for the static induction apparatus. For example, the flow control means may be omitted at upstream side portions (bottom portions as viewed in the drawings) of the vertical coolant passage where relatively better cooling effect can be attained and provided only at the downstream side portions (top portions in the drawings) where temperature rise is likely to occur.

Figure 37:
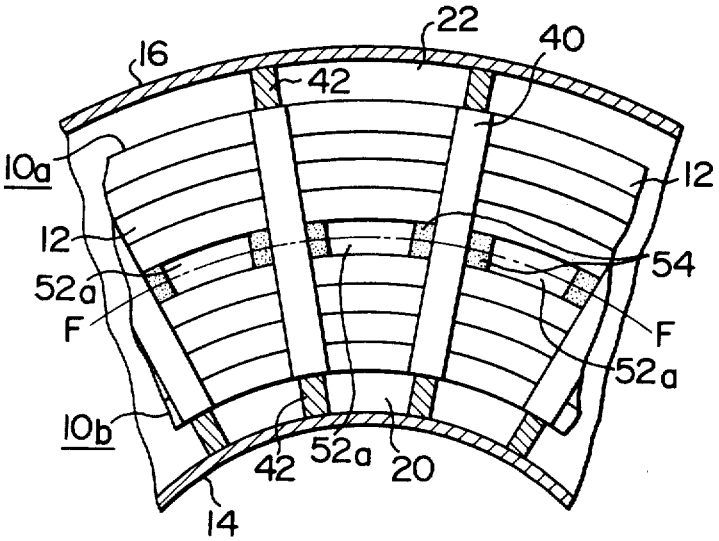
FIG. 37 is a fragmental or partial cross-sectional view showing the winding structure of FIG. 36.
Figure 36:
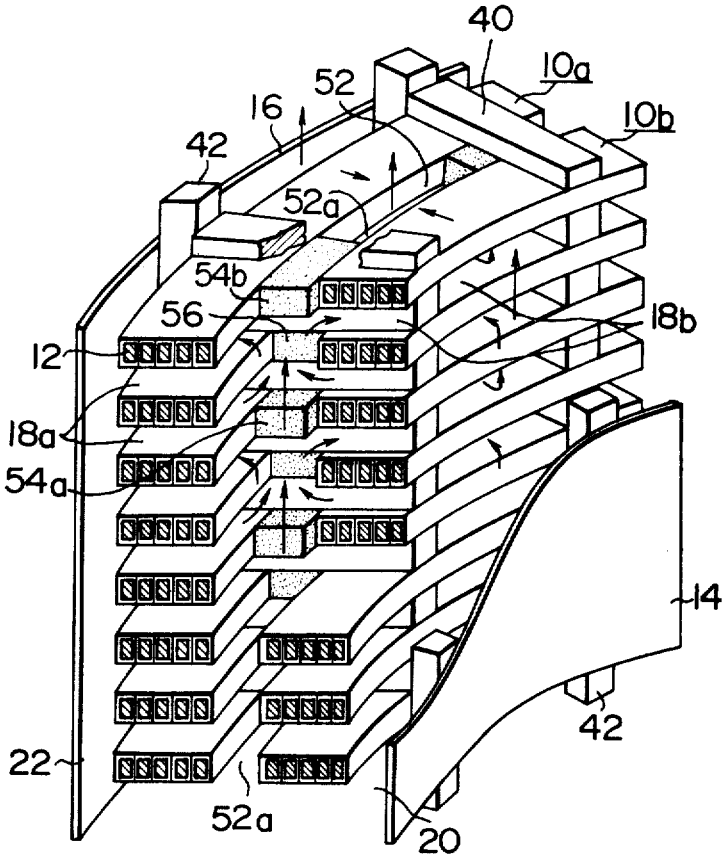
FIG. 36 is a fragmental perspective view showing a main portion of a winding structure for a transformer according to another embodiment of the invention.
Figure 38:
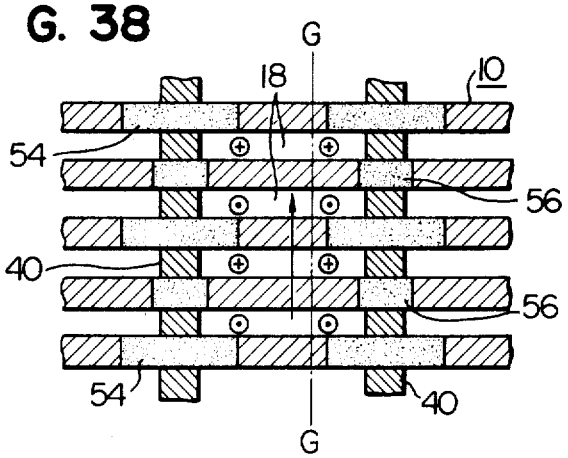
FIG. 38 is a vertical sectional view taken along the line F—F in FIG. 37.
Figure 39:
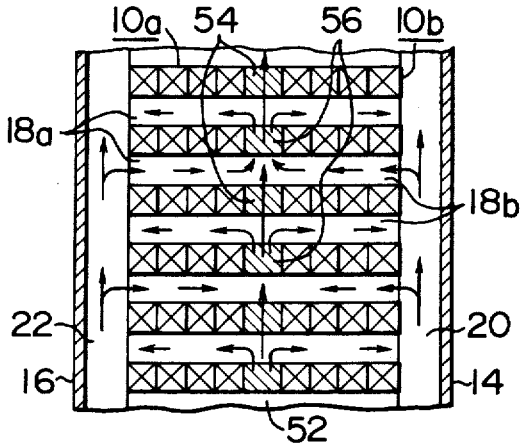
FIG. 39 is a vertical sectional view taken along the line G—G in FIG. 38 to illustrate a pattern of coolant flows.

FIGS. 36 to 39 shows another embodiment of the winding structure according to the invention, in which FIG. 36 is a fragmental perspective view, FIG. 37 shows a fragmental cross-section of the winding structure taken in a direction perpendicular to the axial direction, FIG. 38 is a sectional view taken along the line F—F in FIG. 37, and FIG. 39 is a sectional view taken along the line G—G in FIG. 38 to illustrate the coolant flow pattern.

In the case of the embodiment now being described, the coil unit 10 is divided into two sub-units 10*a* and 10*b* each formed by wound conductor wire 12. These coil sub-units 10*a* and 10*b* are enclosed by the inner and the outer insulation cylinders 14 and 16 through the inner and the outer vertical spacers 42 and disposed in an alignment relation in the vertical or axial direction in a superposed structure, while the coil sub-units 10*a*and 10*b* are spaced from the vertically adjacent sub-units by means of the horizontal spacers 40 thereby to define the horizontal coolant passages 18*a* and 18*b*, respectively.

Flow control members 54 and 56 haviung different circumferential lengths and serving also as intermediate spacers are disposed in a mid vertical coolant passage 52 formed through the division of the coil units 10 into respective sub-units 10*a* and 10*b* and extending continuously through the mid portions of all the coil units 10. The flow control members 54 and 56 are alternately located in the axial direction at a pitch equal to that of the coil units 10 so as to alternately decrease and increase the circumferential width or arcuate length of the intermediate vertical coolant passage 52 for each of the coil units 10. It can be said tht the intermediate vertical coolant passage 52 are divided into a plurality of the passage segments 52*a* by means of the flow control members 54 and 56 and the horizontal spacers 40. The flow control members 54 of a greater length project into the passage segment 52*a* from the lateral sides thereof as viewed in the circumferential direction of the intermediate vertical passage 52 for every other coil units 10, thereby to decrease the circumferential width (arcuate length) of the individual passage segment 52*a*. More specifically, when the flow control members 54*a* having a greater circumferential or arcuate length to decrease the circumferential or arcuate length of the passage segment 52*a* (FIG. 36) are sandwiched between certain coil sub-units 10*a* and 10*b*, then the flow control members 56 each having a shorter circumferential length are disposed between the coil sub-units 10*a* and 10*b* which are located immediately above and below the certain coil sub-units. On above the shorter member 56, another longer member 54*b* is disposed in the same manner as the longer member 54*a*. Such alternate disposition of the flow control members 54 and 56 is repeated in the axial or vertical direction ( refer to FIG. 38), as a result of which each of the intermediate vertical passage segments 52*a* has lateral sides each formed with alternately concaved portions or has portions of the increased circumferential length for every other coil unit 10 in the axial or vertical direction.

Figure 40:
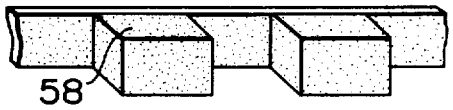
FIG. 40 is a fragmental perspective view showing spacer member mounting band for use in winding structures according to the invention.

The flow control members 54 and 56 may be formed of an electrical insulation materal such as press board and secured to the horizontal spacers 40 or the coil unit through geometrical engagement or bonding. Alternatively, the flow control members 54 and 56 may be formed in an integral spacer band 58 as is shown in FIG. 40 and mounted around the coil sub-unit 10*a* or 10*b*.

With the arrangement of the cooling passages as described above, the fluid coolant in the concaved portions formed at the lateral sides of each of the intermediate vertical coolant passage segments 52*a* is subjected to a drag force by the viscosity of the coolant flowing upwardly through the passage segment 52to be caused to flow.

The upward flow of the coolant is hindered by the lower surfaces of the flow control member 54 having the greater arcuate length thereby to produce a high fluid pressure, whereby the coolant flows from the intermediate passage segments 52*a* toward the inner and the outer vertical coolant passages 20 and 22 will be induced in the horizontal coolant passages 18*a* and 18*b*. On the other hand, there will be produced a low fluid pressure at the region over the upper surface of the longer flow control member 54 due to the abruptly enlarged flow section, as a result of which horizontal coolant flows in the directions from the inner and the outer vertical coolant passages 20 and 22 toward the intermediate vertical passage 52 will be induced in the horizontal coolant passages 18*a* and 18*b* defined above the upper surfaces of the longer flow control members 54. Due to such high and low pressure regions in combination with the drag force exerted by the coolant flowing upwardly through the intermediate vertical passage 52, the coolant flows of the alternately opposite directions are induced in the vertically superposed horizontal passages 18*a* and 18*b* defined between the vertically adjacent coil sub-units 10*a* and 10*b* as indicated by arrows in FIG. 39. The induced horizontal flows are, after having cooled the associated coil sub-units 10*a* and 10*b*, mixed with major vertical coolant flows in the inner and the outer vertical passages 20 and 22 as well as the intermediate vertical passge 52 to dissipate heat therein, and the cooling cycle is repeated. Thus, the coil sub-units 10*a* and 10*b* are uniformly cooled.

Figure 41:
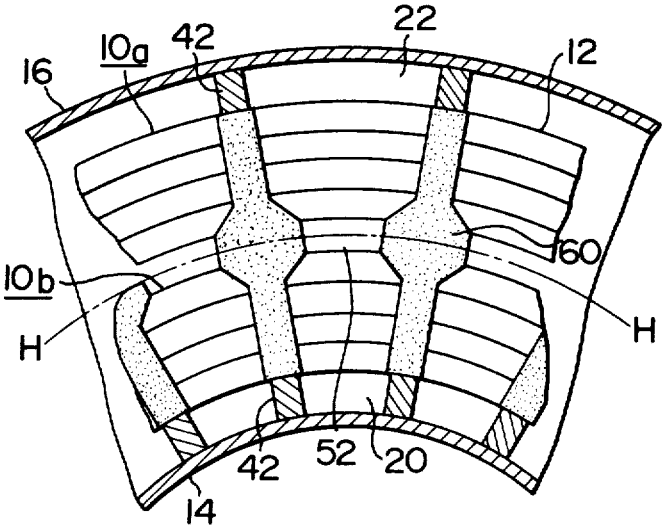
FIG. 41 is a schematic cross-sectional view showing a winding structure for a transformer according to still another embodiment of the invention.
Figure 42:
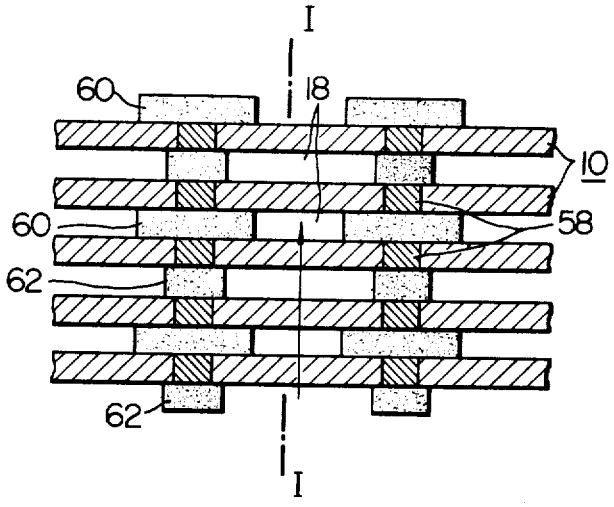
FIG. 42 is a schematic vertical sectional view taken along the line H—H in FIG. 41.
Figure 43:
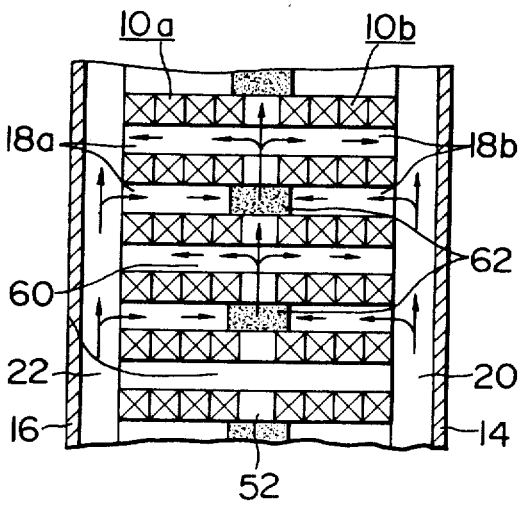
FIG. 43 is a sectional view taken along the line I—I in FIG. 42 to illustrate a pattern of coolant flows.

FIGS. 41, 42 and 43 show still another embodiment of the winding structure according to the invention. In these figures, the parts corresponding or equivalent to those shown in FIGS. 36 to 40 are denoted by the same reference symbols as those used in the latter.

In the case of the winding structure shown in FIGS. 41 to 43, no separate flow control members are employed and instead thereof the horizontal spacers which define the horizontal coolant passages 18*a* and 18*b* between the vertically adjacent coil sub-units 10*a* and 10*b* are themselves used for the flow control. To this end, the horizontal spacers 60 having a wide width and the horizontal spacers 62 of a narrow width are alternately disposed at a vertical pitch corresponding to that of the coil units 10, whereby the circumferential width or arcuate length of each of the intermediate vertical passage segments 52*a* extending through all the coil units 10 is increased for every other coil unit. The width of the horizontal spacers 60 may be enlarged over the whole length thereof or alternatively partially increased at the portion defining the intermediate vertical passage segment 52*a* as shown in FG. 41, or alternatively separate members of an insulation material may be mounted onto the horizontal spacers at the portions defining the intermediate vertical passage segment 52*a*.

With such structure as above described, velocity of the coolant flow at those regions of the intermediate vertical passage segment 52*a* where the circumferential width or the arcuate length is decreased by the horizontal spacer 60 having wide width will be increased to lower the fluid pressure at these regions relative to the pressure in the inner and the outer vertical passages 20 and 22, whereby coolant flows in the direction from the inner and the outer vertical passages 20 and 22 toward the intermediate vertical passage 52 will be induced in the associated horizontal coolant passages 18*a* and 18*b* under suction as indicated by arrows. On the other hand, the velocity of the coolant flow is decreased upon passing through those regions where the circumferential width of the intermediate vertical passage segment 52*a* is increased, as a result of which the pressure in the inner and the outer vertical passages 20 and 22 will become higher. Under the conditions, the coolant flows in the direction from the intermediate vertical passage 52 toward the inner and the outer vertical passages 20 and 22 will be induced in the horizontal coolant passages 18*a* and 18*b* opened in these regions. The horizontal coolant flows are, after having cooled the associated coil sub-units 10*a* and 10*b*, mixed with the major coolant flows in the inner and the outer vertical passages 20 and 22 as well as in the intermediate vertical passage 52 to dissipate heat therein. The cooling cycle is repeated.

Figure 44:
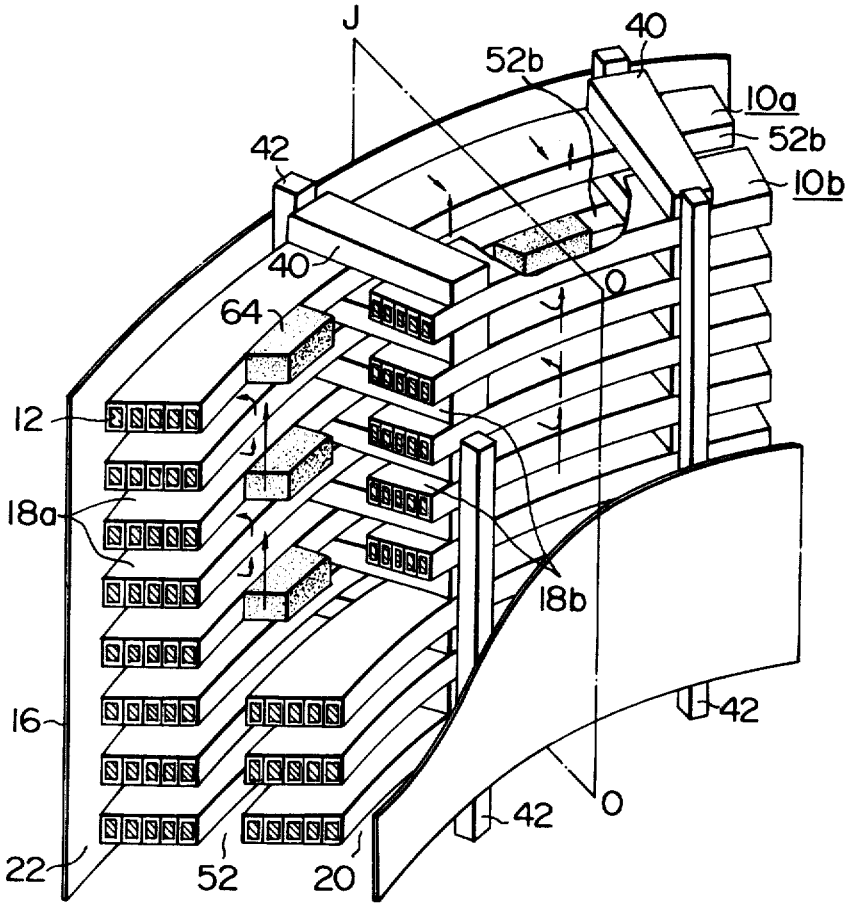
FIG. 44 is a fragmental perspective view showing a main portion of a winding structure for a transformer according to still another embodiment of the invention.
Figure 45:
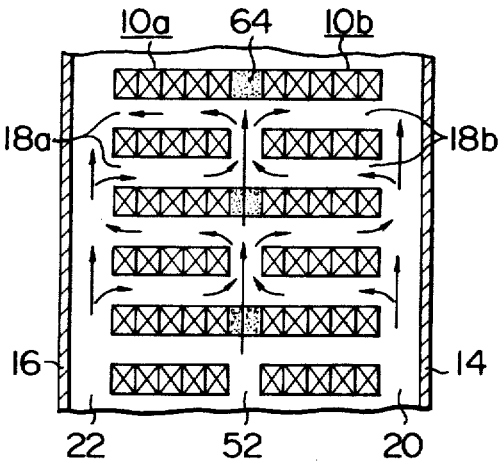
FIG. 45 shows a schematic section taken along the plane OJJO in FIG. 44.

FIGS. 44 and 45 show still another embodiment of the winding structure according to the invention, which is similar to the winding structure shown in FIG. 36 as a whole and differs from the latter in respect of the arrangement of the flow control members. In the case of the winding structure shown in FIG. 36, the flow control membrs 54 and 56 are disposed between the adjacent horizontal spacers 40, i.e. at the lateral sides of the intermediate vertical passage segment 52*a*. In contrast thereto, the flow control member is disposed, in this embodiment, at a substantially circumferentially mid portion between two circumferentially adjacent horizontal spacers 40.

Strictly speaking, the intermediate vertical coolant passage is not divided into segments because each space between two axially adjacent horizontal spacers 40 is not blocked by the member 64. However, it may be possible to suppose such a small region 52*b* between two circumferentially adjacent vertically aligned arrays of horizontal spacers 40. This region 52*b* is different from the vertical coolant passage segment 52*a* in the previous embodiments in the point that the former communicates with the circumferentially adjacent regions 52*b* through the spaces between vertically adjacent horizontal spacers.

In more particular, by the way, the flow control members 64 are disposed at mid portion of the intermediate vertical passage region 52*b* for every other coil units 10, i.e. at a pitch of twice as large as the pitch P of the coil units 10 in a vertical or axial alignment. Such an array of those flow control members 64 disposed in an axial alignment acts to vary the circumferential length of the intermediate vertical passage region 52*b* at the vertical pitch corresponding to that of the coil units 10. In this connection, it is mentioned that the flow control members 64 in a given intermediate vertical passage region 52*b* should be preferably staggered in respect to the horizontal postions from the flow control members 64 in the passage regions 52*b* which are located circumferentially adjacent to the given passage region 52*b*. In other words, the coil unit which is provided with the flow control member 64 in a given intermediate vertical passage region is not provided with any flow control member in the passage regions 52*b* located circumferentially adjacent to the given passage region 52*b*.

The flow control member 64 may be made of an electrical insulation material such as a press board and secured to the associated coil unit through geometrical engagement or bonding. Alternatively, the flow control members may be integrally formed with the spacer band and mounted around the coil sub-unit 10*a* or 10*b*.

With such structure as above described, the coolant fluid in the spaces defined between the flow control members 64 in the intermediate vertical passage region 52*b* will be subjected to a drag force due to the viscosity of the cooling medium flowing upwardly in the passage region 52*b* to be caused to flow. In the portion below the lower surface of the flow control member 64, there will be produced a high fluid pressure because of the stagnation of the coolant in this portion, whereby horizontal coolant flows in the direction from the intermediate vertical passage 52 to the inner and/or the outer vertical coolant passages 20 and 22 will be induced in the horizontal passages 18*a* and 18*b* opened in this high pressure portion. On the other hand, the fluid pressure will become lowered in the portion above the upper surface of the flow control members 64 because of the abruptly increased flow cross-section. Thus, there will be induced the coolant flows in the direction from the inner and the outer vertical passages 20 and 22 towards the intermediate vertical passage region **52*b* in the horizontal passages opened in this portion. In this manner, coolant flows of alternately opposite directions will be produced in the vertically adjacent horizontal passages 18*a* and 18*b* defined between the coil sub-units 10*a* and 10*b*, respectively, as indicated by arrows. The induced horizontal coolant flows are, after having cooled the associated coil sub-units 10*a* and 10*b*, mixed with the major coolant flows in the inner and the outer vertical pasasges 20 and 22 as well as in the intermediate vertical passage to dissipate heat. The cooling cycle is repeated to cool the coil sub-units 10*a* and 10*b*** uniformly.

Figure 46:
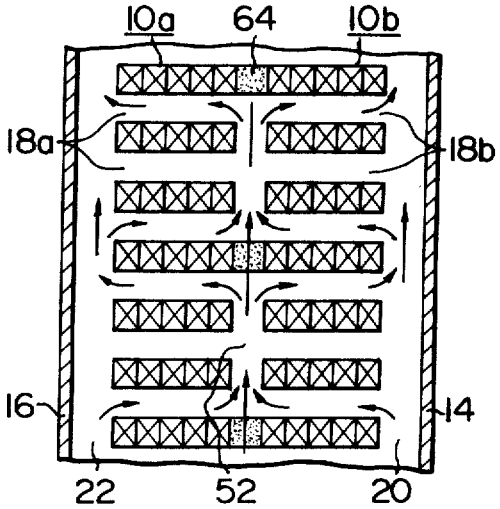
FIGS. 46 and 47 are schematic vertical sectional views showing further embodiments of the winding structure according to the invention.
Figure 47:
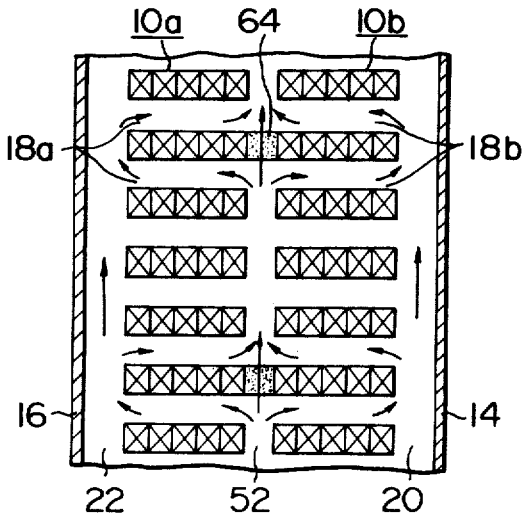

Although the pitch of the flow of control members 64 in the axial or vertical direction is selected at a value twice as large as the axial pitch P of the coil units 10, i.e. equal to 2P in the above described winding structure, it will be appreciated that the pitch of the flow control members 64 may be selected at 3P as is in the case of a winding structure shown in FIG. 46 or at 4P in the case of the winding structure of FIG. 47 or at other values in a reasonable range. The components or parts corresponding or equivalent to those shown in FIGS. 44 and 45 are denoted by the same reference characters also in FIGS. 46 and 47.

Figure 48:
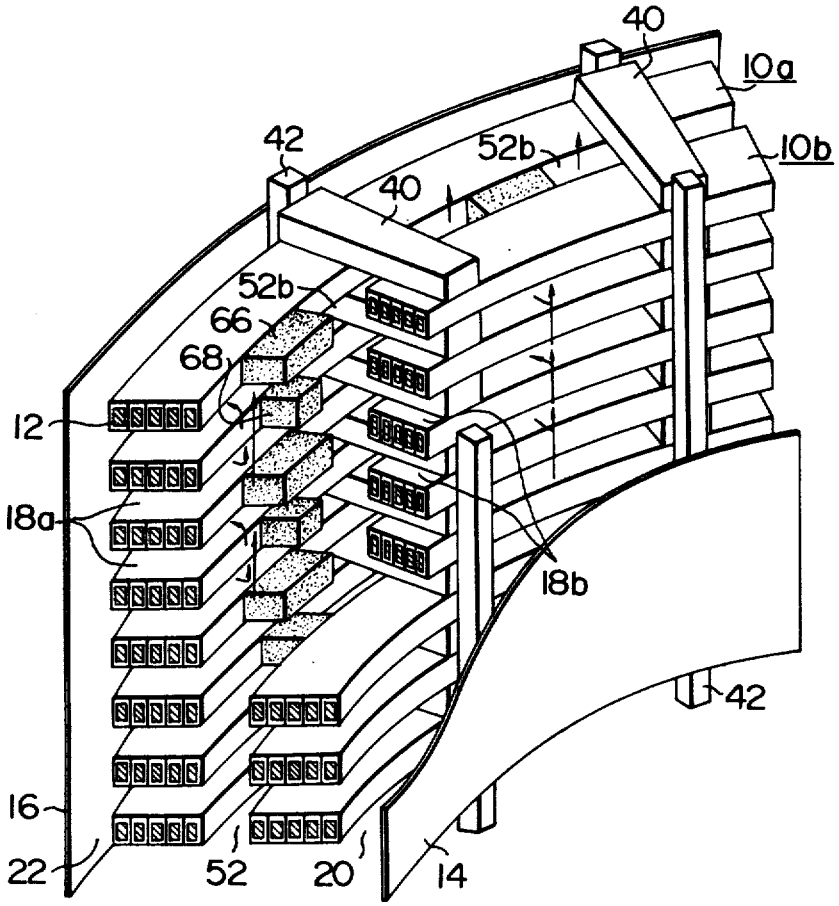
FIG. 48 is a fragmental perspective view showing a main portion of a winding structure for a transformer according to a further embodiment of the invention.

Another winding structure according to an embodiment of the invention is shown in FIG. 48 in which components or parts corresponding or equivalent to those shown in FIGS. 44 and 45 are designated by the same reference characters.

In the case of the winding structure shown in FIG. 48, flow control members 66 and 68 of different circumferential widths (or arcuate length) which serve also as the spanning spacers for assuring the intermediate vertical passage region **52*b* between the divided coil sub-units 10*a* and 10*b* are alternately provided for every coil units 10. More specifically, when the flow control member 66 of a large width is sandwiched between given coil sub-units 10*a* and 10*b* in the intermediate passage region 52*b*, then the flow control member 68 of a small width is sandwiched between the coil sub-units 10*a* and 10*b* which are located immediately above and below the given coil sub-units in a vertical alignment with one another in the same passage region 52*b*, and this alternate array of the flow control members 66 and 68** of large and small width is repeated.

The winding structure described above in conjunction with FIG. 48 will exhibit substantially same cooling action for the coil sub-units as the winding structure shown in FIGS. 44 and 45. Further, because of the simultaneous function of the flow control members as the spanning spacers for fixing the coil sub-units **10*a* and 10*b***, the mechanical strength of the whole winding structure can be enhanced.

Figure 49:
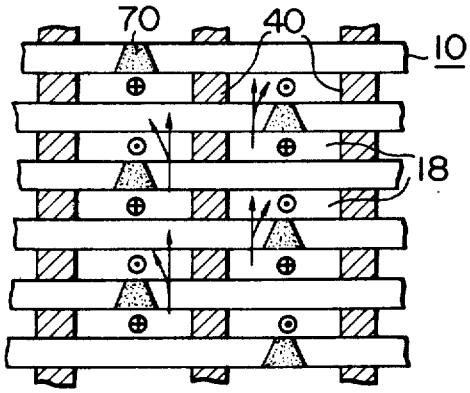
FIGS. 49 and 50 are vertical sectional views taken along intermediate vertical cooling passages of further winding structures according to the invention, respectively.

FIG. 49 shows another winding structure according to the invention, wherein there are used flow control members whose cross-sectional area in the plane perpendicular to the axial direction of the winding is progressibly decreased in the flow direction of the coolant. Specifically, the flow control member 70 is of a triangular or trapezoidal cross section as viewed in a plane parallel with the circumference of the winding. When the flow control members 70 are disposed in a similar array as the one shown in FIG. 44, the coolant flowing through the intermediate vertical passage region **52*b* will tend to flow in the directions inclined relative to the axis of the winding along the correspondingly inclined side surfaces of the member 70. Thus, the coolant flow having passed by a certain flow control member 70 will then impinge on the bottom surface of the succeeding flow control member disposed at the downstream side. Such flowing process is sequentially repeated, whereby there can induced in the horizontal coolant passages 18*a* and 18*b* more forceful horizontal coolant flows than those induced in the structure shown in FIG. 44**.

Figure 50:
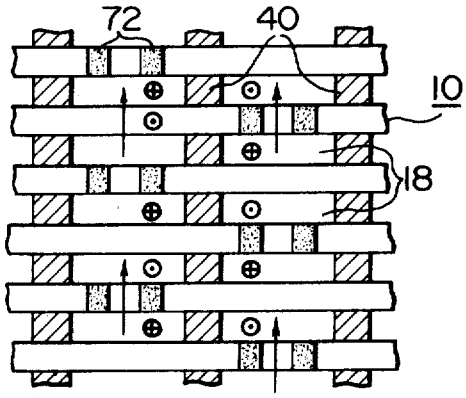
Figure 51:
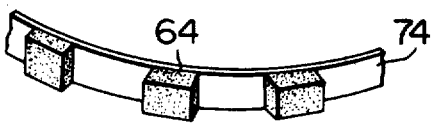
FIGS. 51 and 52 are fragmental perspective views showing mounting bands for securing flow control members for use in the winding structures according to the invention.

FIG. 50 shows still another embodiment of the invention in which two vertical arrays of the flow control members 72 are provided in the single intermediate vertical passage region **52*b*. More than two vertical arrays of the flow control members 72** may be disposed in the single intermediate vertical passage segment, so far as the fluid pressure loss can be maintained below an acceptable limit.

Although the mounting positions of the flow control members are aligned with the axial direction of the winding in the winding structures described above, it will be appreciated that these positions of the flow control members may be deviated from one another in the circumferential direction for every coil unit. However, the disposition of the flow control members in alignment with the axial direction of the winding is preferred because the most forceful coolant flows can then be induced in the horizontal passages.

Further, the flow control members for decreasing periodically the flow sectional area of the intermediate vertical coolant passage are not necessarily disposed over the whole length of the passage. For example, they may be disposed only at the downstream side (top portion in the drawings) of the intermediate vertical coolant passage where temperature rise is likely to occur.

For mounting the flow control members in the case of the structure shown in FIG. 44, the flow control members 64 of a radial thickness substantially equal to the radial width of the intermediate vertical passage are at first secured onto a mounting band 74 of a width substantially equal to the axial thickness or height of the coil unit 10 with distance between the adjacent flow control members 64 being selected equal to two pitches of the intermediate vertical passage segments **52*a* in the circumferential direction. Thereafter, the mounting band 74 is mounted around each of the coil sub-unit 10*a* or 10*b* by winding together with the conductor wires at such a position that the flow control member 64 may make appearance in the intermediate vertical passage region 52*b*** for every other coil unit, i.e. with an axial pitch twice as large as that of the coil units.

Figure 52:
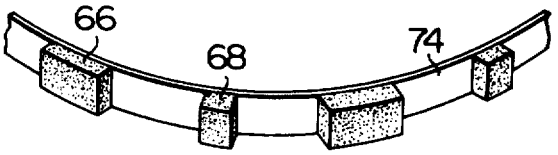

FIG. 52 illustrates a manner for mounting the flow control members 66 and 68 of different circumferential lengths on the mounting band 74. The winding structure shown in FIG. 48 can be implemented by using the band 74 shown in FIG. 52, which is mounted around the coil sub-unit **10*a* or 10*b* at such position that the flow control members 66 and 68 of the different dimensions may make appearance alternately for every coil unit in the intermediate vertical passage region 52*b***.

Although description has been made above with respect to such embodiments wherein cylindrical winding assembly and cylindrical inner and outer insulators, the scope of the present invention is not restricted to such cylindrical ones. Each of the inner and outer ensulator may be a continuous wall which extends in the axial direction of the container and may have a suitable cross-section, such as a rectangle, a square, a triangle, etc. It will be appreciated that the winding assembly is not always a cylindrical one but it may have a suitable cross section like the inner and outer insulators in accordance with the purpose of the apparatus wherein this winding assembly is used.

We claim:

1. A static electrical induction apparatus comprising:

a container having an axis extending in the vertical direction;

a pair of inner and outer insulation continuous walls disposed in said container so as to commonly include said vertical axis thereby defining a predetermined space therebetween;

a winding assembly disposed in said space in a manner so that an inner vertical coolant passage is formed between said winding assembly and said inner insulation continuous wall and an outer vertical coolant passage is formed between said windings assembly and said outer insulation continuous wall, said winding assembly being composed of a plurality of coil units stacked on one another in the vertical direction with separation at predetermined intervals so as to form a plurality of horizontal coolant passages between vertically adjacent ones of said coil units, said inner and outer vertical coolant passages communicating with each other through said horizontal coolant passages; and a plurality of coolant flow control members disposed in circumferentially and axially discrete relation from one another in at least selected one of said inner and outer vertical coolant passages in a manner so that a horizontal sectional area of said selected vertical coolant passage is decreased, but not substantially completely closed, periodically at a pitch of nP along the vertical direction where n represents an integer which is not smaller than two (2) and P represents a pitch of said coil units along the vertical direction, each of said coolant flow control members having a width in a radial direction perpendicular to said vertical axis being selected to closely correspond to a width in the radial direction of said selected vertical coolant passage, each of said coolant flow control members having a height in the vertical direction being selected to closely correspond to a height in the vertical direction of each of said horizontal coolant passages, said coolant flow control members being disposed in said selected vertical coolant passage at predetermined portions that are opposite the selected ones of said horizontal coolant passages.

2. A static electrical induction apparatus comprising:

a container having an axis extending in the vertical direction;

a pair of inner and outer insulation continuous walls disposed in said container so as to commonly include said vertical axis thereby defining a predetermined space therebetween;

a winding assembly disposed in said space in a manner so that an inner vertical coolant passage is formed between said winding assembly and said inner insulation continuous wall and an outer vertical coolant passage is formed between said winding assembly and said outer insulation continuous wall, said winding assembly being composed of a plurality of coil units stacked on one another in the vertical direction with separation at predetermined intervals so as to form a plurality of horizontal coolant passages between vertically adjacent ones of said coil units, said inner and outer vertical coolant passages communicating with each other through said horizontal coolant passages; and a plurality of coolant flow control members disposed in circumferentially and axially discrete relation from another in at least selected one of said inner and outer vertical coolant passages in a manner so that a horizontal sectional area of said selected vertical coolant passage is decreased, but not substantially completely closed, periodically at a pitch of nP along the vertical direction where n represents an integer which is not smaller than two (2) and P represents a pitch of said coil units along the vertical direction, each of said coolant flow control members having a width in a radial direction perpendicular to said vertical axis being selected to closely correspond to a width in the radial direction of said selected vertical coolant passage, said coolant flow control members being supported on selected ones of vertically extending spacer members disposed in said inner and outer vertical coolant passages for ensuring said inner and outer vertical coolant passages respectively and horizontally extending spacer members disposed in said horizontal coolant passages for ensuring said horizontal coolant passages.

3. A static electrical induction apparatus comprising:

a container having an axis extending in the vertical direction;

a pair of inner and outer insulation continuous walls disposed in said container so as to commonly include said vertical axis thereby defining a predetermined space therebetween;

a winding assembly disposed in said space in a manner so that an inner vertical coolant passage is formed between said winding assembly and said inner insulation continuous wall through a first plurality of vertically extending spacer members and an outer vertical coolant passage is formed between said winding assembly and said outer insulation continuous wall through a second plurality of vertically extending spacer members, said winding assembly being composed of a plurality of coil units stacked on one another in the vertical direction with separation at predetermined intervals so as to form horizontal coolant passages between vertically adjacent ones of said coil units, said inner and outer vertical coolant passages communicating with each other through said horizontal coolant passages, said inner and outer vertical coolant passages being divided into a plurality of segments by said first and second spacer members respectively, each of said segments of said inner vertical coolant passage communicating mainly with corresponding one of the segments of said outer vertical coolant passage which is substantially opposite thereto through said winding assembly, through portions of said plurality of horizontal coolant passages; and a plurality of coolant flow control members disposed in circumferentially and axially discrete relation from one another in at least selected one of said inner and outer vertical coolant passages is decreased periodically at a pitch of nP along the vertical direction, wherein n represents an integer which is not smaller than two (2) and P represents a pitch of said coil units along the vertical direction, each of said coolant flow control members having a width in a radial direction perpendicular to said vertical axis being selected closely correspond equal to a width in the radial direction of said selected vertical coolant passage, each of said coolant flow control members having a height in the vertical direction being selected to closely correspond to a height in the vertical direction of each of said horizontal coolant passages, said coolant flow control members being disposed at predetermined portions in the respective segments of said selected vertical coolant passage that are horizontally opposite to selected ones of said horizontal coolant passages.

* * * * *